US006934222B2

(12) United States Patent
Fujimori

(10) Patent No.: US 6,934,222 B2
(45) Date of Patent: Aug. 23, 2005

(54) ELECTRONIC TIMEPIECE INCLUDING ROTARY WEIGHT AND ANTENNA

(75) Inventor: Shigeyuki Fujimori, Chino (JP)

(73) Assignee: Seiko Epson Corporation, Tokyo (JP)

( * ) Notice: Subject to any disclaimer, the term of this patent is extended or adjusted under 35 U.S.C. 154(b) by 82 days.

(21) Appl. No.: 10/397,822

(22) Filed: Mar. 26, 2003

(65) Prior Publication Data

US 2004/0004909 A1 Jan. 8, 2004

(30) Foreign Application Priority Data

Mar. 27, 2002 (JP) ..... P2002-089630
Mar. 18, 2003 (JP) ..... P2003-073882

(51) Int. Cl.[7] ..... G04B 1/02; G04C 11/02
(52) U.S. Cl. ..... 368/204; 368/47
(58) Field of Search ..... 368/47, 204, 203

(56) References Cited

U.S. PATENT DOCUMENTS 3,306,025 A * 2/1967 Kocher ..... 368/148
5,798,984 A * 8/1998 Koch ..... 368/10
6,643,223 B2 * 11/2003 Fujisawa ..... 368/204
2004/0090868 A1 * 5/2004 Endo et al. ..... 368/10
2004/0105347 A1 * 6/2004 Fujimori et al. ..... 368/293
2004/0233794 A1 * 11/2004 Maruyama et al. ..... 368/157

FOREIGN PATENT DOCUMENTS

| | | |
|---|---|---|
| JP | 2-118889 | 9/1990 |
| JP | 7-217280 | 8/1995 |
| JP | 2001-166071 | 6/2001 |

* cited by examiner

*Primary Examiner*—Leslie J. Evanisko

(57) ABSTRACT

The driving portion 4 is composed of multipolar motor 43. The multipolar motor 43 includes a coil 431 for multipolar motor 43, a stator 432 for multipolar motor 43, for transmitting a magnetic field from coil 431, and a rotor 433 for multipolar motor 43 installed ratably in a stator hole of stator 432. A multipolar magnet is provided on a peripheral part of rotor 433. A plurality of teeth are formed on stator 432 toward rotor 433. Clock hands for displaying time are installed on the rotation axis of rotor 433.

19 Claims, 18 Drawing Sheets

ELECTRONIC TIMEPIECE INCLUDING ROTARY WEIGHT AND ANTENNA

TECHNICAL FIELD

The present invention relates to an electronic timepiece and an electronic apparatus, and more specifically, it relates to an electronic timepiece and an electronic apparatus having a power-generation mechanism by a rotary weight and a receiving mechanism for receiving wireless information.

BACKGROUND ART

As an electronic apparatus such as an electronic timepiece having a function for receiving wireless information, there is known, for example, a radio wave clock for receiving time information wirelessly transmitted (standard radio waves) and performing time correction. Such a radio wave clock is normally driven by battery, but since power is consumed by radio wave reception, the lifetime of the battery is shorter than a normal clock, there is a problem that the battery should be replaced very often.

Because of this, a radio wave clock having a solar power-generation mechanism installed as a power-generation mechanism is known (for example, Japanese Unexamined Patent Application Publication No. 11-160464).

The radio wave clock having a solar power-generation mechanism includes a solar battery as a solar power-generation mechanism, a receiving mechanism having an antenna for receiving time information, and a time-measuring mechanism for measuring time, the time of the time-measuring mechanism being corrected according to the time information received by the antenna.

By such a structure, the time-measuring mechanism and the receiving mechanism can be driven by using the power generated by the solar power generation. Therefore, only if the solar battery generates and charges from solar light, the clock having a solar power-generation mechanism can be used as a radio wave clock driven semi-permanently.

However, there is a problem in a solar power-generation mechanism that it does not always efficiently operate according to daylight amount (for example, cloudy or rainy weather), seasons (for example, winter), regions (for example, high latitude region), etc., so that it sometimes cannot supply power. The radio wave clock needs a large amount of power since the received time information should be processed (amplification, demodulation) by the receiving mechanism. Because of this, if sufficient power is not supplied to the receiving mechanism, time information cannot be received, or wrong time information is received, the receiving sensitivity of the receiving mechanism is decreased. Further, there is also a problem that a rapid charge is impossible in the solar battery if light is weak.

Because of this, the radio wave clock having the solar power-generation mechanism is not necessarily a convenient clock.

Therefore, the inventor of the present invention studied a method of incorporating a power-generation mechanism using a rotary weight inside the radio wave clock. The power-generation mechanism using a rotary weight includes a rotary weight rotatably installed, and a generator for converting the mechanical energy by the rotary weight to electrical energy, and a rotor of the generator is rotated by the rotary weight, and power generation occurs in a power-generation coil by the change of magnetic flux accompanied by the rotation. By such a structure, power can be generated, for example, by wearing the electronic timepiece in which the power-generation mechanism is installed on an arm, and moving the rotary weight. Therefore, compared with the solar power generation, the power generation by using the rotary weight is possible regardless of seasons, daylight amount, etc., and also has an advantage that much faster power generation can be easily performed.

However, the rotary weight needs to have sufficient moment of inertia to make sufficient energy by the movement of the rotary weight. Because of this, as a material of the rotary weight, a metal of high weight (heavy metal) such as tungsten alloy or gold alloy is normally used. If the power-generation mechanism by such a rotary weight is simply installed in the radio wave clock, the conductive rotary weight of a metal material shields the time information to be received by the antenna. Therefore, there occurs a new problem that the standard radio waves cannot be received if the power-generation mechanism using the rotary weight is installed in the radio wave clock.

Such a problem is not limited to an electronic timepiece having a radio wave correction function, and it is a common problem in various electronic apparatus having a power-generation mechanism by a rotary weight, and an antenna receiving wireless information from the outside.

The object of the present invention is to solve the above problems, and to provide an electronic timepiece and an electronic apparatus which can generate electricity by a power-generation mechanism having a rotary weight, and can receive wireless information.

DISCLOSURE OF INVENTION

An electronic timepiece of the present invention includes a power-generation mechanism having a rotary weight made from a conductive material and a generator for converting the mechanical energy generated by the rotation of the rotary weight into electrical energy, a time-measuring mechanism for measuring time, and a receiving mechanism having an antenna for receiving wireless information, and the antenna is located outside a radius of the rotation path of the outer circumferential edge of the rotary weight.

That is, when the rotary weight is rotated, the antenna is located outside the rotation path of the outer circumferential edge of the rotary weight in the radial direction, instead of inside thereof which is nearer to the rotation center of the rotary weight. Therefore, assuming that the rotation radius is the radius from the rotation center of the rotary weight to the rotation path of the outer circumferential edge of the rotary weight, the antenna is further away from the rotation center of the rotary weight further than the rotation radius in its radial direction.

Here, the power-generation mechanism may be for an electromagnetic power generation, or piezoelectric power generation. From the aspect of energy conversion efficiency, the electromagnetic power generation is more suitable compared with the piezoelectric power generation.

By such a structure, the mechanical energy generated by the rotation of the rotary weight is converted into electrical energy by a generator having a rotor and a power-generation coil. By the power generated by the generator, the time-measuring mechanism or the receiving mechanism is driven. By receiving wireless information by the antenna, if the wireless information is, for example, a standard radio wave including the time information, the time of the time-measuring mechanism is corrected based on the time information.

Since the antenna is installed outside the rotation path of the outer circumferential edge of the rotary weight in the radial direction, the antenna and the rotary weight do not overlap two-dimensionally whichever position the rotary weight takes. Therefore, while the antenna receives wireless information, even if the rotary weight is rotated, the wireless information (radio waves) is not shielded by the rotary weight, and the wireless information can be surely received by the antenna. In the above, the wireless information is not limited to time information, and also includes, for example, news, weather reports, etc.

Therefore, since the electronic timepiece of the present invention receives wireless information, and also performs the power generation by the rotary weight and the generator, it can perform the power generation regardless of weather or season, and since rapid power generation can be also performed, a very convenient electronic timepiece can be provided. Further, it is preferable to install an accelerating wheel train between the rotary weight and the rotor.

Further, the rotary weight may be installed to be rotatable at an angle of 360° or more, or to be rotatable within the range that the central angle is restricted to a predetermined angle less than 360°. If the rotation angle of the rotary weight is restricted to a predetermined range, the rotation path of the antenna becomes small so that the clock can have more space to place the antenna. Then, the degree of freedom in the placement of the antenna is improved. Further, it is possible to achieve long distance between the antenna and the rotary weight so that the receiving sensitivity of the antenna can be improved.

The electronic timepiece of the present invention is preferably configured such that the antenna and the power-generation coil of the generator face each other in the radial direction of the rotary weight with the rotation center of the rotary weight therebetween.

If the magnetic field generated from the coil for power-generation affects the antenna, the magnetic field may overlap the antenna along with the wireless information, and there occurs the case that wireless information cannot be received by the antenna exactly. Because of that, it becomes necessary to receive the wireless information again or the like, so that the receiving efficiency is decreased. Because of this, it is preferable to install the antenna and the power-generation coil with as long a distance as possible therebetween, and to reduce the impact of the magnetic field by the power-generation coil. In the meantime, to achieve the miniaturization of the electronic timepiece having the rotary weight, it is preferable to install each member such as the generator inside the rotation path of the rotary weight, and to install only the antenna outside that.

Because of this, if the antenna and the power-generation coil are installed to face each other with the rotation center of the rotary weight therebetween, the antenna and the power-generation coil can be disposed with a longest possible distance therebetween, and the miniaturization of the electronic timepiece can be achieved.

Here, the central axis through which the interlink magnetic flux of the antenna passes and the central axis through which the interlink magnetic flux of the power-generation coil of the generator passes are preferably cross each other at an angle of 60° to 120° in the case of projecting the antenna on the plane including the power-generation coil. Particularly, the respective central axes of the antenna and the power-generation coil preferably cross each other at an angle of about 90° in the projection plane projected from the viewing direction of the time display part.

Further, it is preferable that the central axis through which the interlink magnetic flux of the antenna passes crosses with the plane including the central axis through which the interlink magnetic flux of the power-generation coil of the generator pass at an angle of 60° to 120°. Particularly, the crossing angle is preferably about 90°.

By such a structure, the impact of the magnetic field generated from the power-generation coil on the antenna can be reduced, and the erroneous reception by the antenna due to the magnetic field can be reduced. That is, if each central axis of the antenna and the power-generation coil is crossed within the range of 90°±30° on the projection plane, or the central axis of the antenna is crossed within the range of 90°±30° on the plane including the central axis of the power-generation coil, the antenna does not follow the line of the magnetic flux from the power-generation coil, and it is difficult for the magnetic field from the power-generation coil to interfere with the antenna so as to prevent the erroneous reception in the antenna.

Further, it is preferable to install magnetic field shielding means between the antenna and the power-generation coil of the generator, for shielding the inflow of the magnetic field generated from the power-generation coil into the antenna.

As the magnetic field shielding means, there may be provided one or more magnetic field shielding members, being made from a ferromagnetic material which easily induces and allows the line of the magnetic force from the generator to pass, along the antenna. The magnetic field shielding member is specifically made from steel, nickel, cobalt, or alloy thereof (for example, a high magnetic permeability member such as premalloy)

By such a structure, since there is installed the magnetic field shielding means between the antenna and the power-generation coil, the magnetic field (the line of the magnetic force) from the power-generation coil passes through the magnetic field shielding means (magnetic field shielding member) to bypass, and since the line of the magnetic force passing through the antenna can be small, the magnetic field shielding member functions as a magnetic field shield for the antenna so as to shield the magnetic circuit passing through the antenna. Because of this, while wireless information is received by the antenna, even though the power-generation coil generates by the rotation of the rotary weight and the magnetic field is generated therefrom, the magnetic flux easily flows the magnetic field shielding means more adjacent to the power-generation coil than the antenna. Therefore, the magnetic field from the power-generation coil is difficult to reach the antenna, and as a result, even the relatively weak wireless information like standard radio waves can be received surely.

Further, there are preferably installed a stepping motor for driving hands to indicate time, and the magnetic field shielding member of the magnetic field shielding means including a coil core having the motor coil of the stepping motor wound.

Further, there is installed a secondary battery for storing the power generated from the power-generation mechanism, and the magnetic field shielding member of the magnetic field shielding means preferably includes the case of the secondary battery.

The magnetic field shielding member can employ an additional new member for magnetic field shielding, but if using the components for clock such as the coil core of the motor or the case of the secondary battery, the increase of the number of components can be decreased, and the receiving antenna and the generator can be installed closely so that the space saving can be facilitated, and the component cost can be reduced, and the productivity decrease can be prevented.

Further, in the stepping motor or the secondary battery, if the magnetic flux flows into the coil core or the case, it does not affect the driving of the motor or the operation of the secondary battery, which occurs no problem.

Here, the magnetic field shielding means can be composed of one or more stepping motors only, one or more secondary batteries only, or one or more stepping motors and one or more secondary batteries.

And, in the case that there are installed two or more magnetic field shielding members such as the stepping motor or the secondary battery, these magnetic field shielding members are preferably installed along the antenna to the side of the power-generation coil of the antenna.

Further, the antenna core of the antenna shields the external magnetic field penetrating from the outside of the clock body into the clock body before the stepping motor, and the antenna functions as a magnetic field shielding member for the stepping motor. And, by shielding the external magnetic field by the antenna, the malfunctioning of the stepping motor can be suppressed.

The electronic timepiece of the present invention preferably uses standard radio waves including time information as the wireless information, and is preferably a radio wave correction clock which corrects the time of the time-measuring mechanism by receiving the standard radio wave.

By such a structure, since time code of wireless information is received by a receiving mechanism, and the time of the time-measuring mechanism is corrected based on the received time code, when long wave standard radio waves are employed as time information, for example, the electronic timepiece of the present invention can be a radio wave clock which can automatically and surely correct time. Particularly, since the standard radio waves are relatively weak radio waves, if the rotary weight made from a conductive material overlaps the antenna two-dimensionally, the radio waves are hardly received. However, according to the present invention, there is no case that the antenna overlaps the rotary weight two-dimensionally so that the radio waves can be received surely.

Further, since in the electronic timepiece of the present invention, electric power is generated by the rotary weight, it is preferably used as a portable clock which is normally carried by a user as a wristwatch or pocket watch, and performs the power generation by the rotary weight utilizing the user's movements, etc.

The electronic timepiece of the present invention comprises a case body made from a non-conductive material member, for receiving the power-generation mechanism and the time-measuring mechanism therein, and an external manipulation portion protruded out of the case body in the direction crossing the rotation axial direction of the rotary weight, and the antenna is preferably installed to the side of the external manipulation portion. Further, the external manipulation portion includes a metal winding stem which penetrates into the case body and is preferably disposed on the extension of the axial line of the antenna.

By such a structure, by the winding stem of the external manipulation portion, the standard radio waves are induced on the axial line of the antenna, and the interlink magnetic flux of the antenna is increased so that the receiving sensitivity of the antenna can be improved.

Further, the rotary weight is preferably located furthest apart from the antenna in its rotation path while the antenna receives the wireless information. In the case of placing the clock somewhere, the clock is normally placed with the winding stem protruded out of the case body directed upwardly. If the winding stem is directed upwardly, the rotary weight is moved downwardly opposite to the winding stem. Therefore, when the clock is put somewhere, the antenna and the rotary weight are furthest away from each other. Since the antenna and the rotary weight are furthest apart from each other, the standard radio waves can reach the antenna without shielded by the rotary weight, and thus the receiving sensitivity of the antenna can be improved. Particularly, in the case of setting the receiving time of standard radio waves to be midnight such as 2 o'clock a.m., since there is a high possibility that the standard radio waves are received with the clock being placed as above, because of the structure in which the rotary weight and the antenna are placed furthest apart from each other, the receiving sensitivity of the antenna during the reception can be improved.

Here, the antenna is preferably of a flat type having coils wound around a plane-shaped axial core. Such a flat-typed antenna allows the antenna and the winding stem to be placed to the same side.

In the present invention, the antenna is preferably shaped to curve along the peripheral part of the movement for clock, and is preferably installed along the peripheral part of the movement.

By such a configuration, since the antenna has a shape following the movement, the movement and the antenna are continuously integrated by their appearances. Then, since the antenna is not protruded from the movement, the clock is miniaturized on the whole, and the design can be improved.

Here, the antenna includes an antenna core as an axial core and antenna coils wound around the antenna core, and the antenna core is preferably formed by stacking a plurality of sheets made from a thin-plate shaped amorphous metal.

By such a structure, since the amorphous metal is relatively easily bendable, and adaptable to be curved compared with ferrite, etc., it is possible to curve the antenna along the peripheral part of the movement, and by making the antenna along the movement, the design of the clock can be improved.

Alternatively, the movement may include a control circuit and a circuit receptacle seat made from an insulating material member to receive the control circuit therein, and the antenna is preferably mounted on the circuit receptacle seat.

In such a structure, since the antenna is mounted on the circuit receptacle seat, the antenna can be placed adjacent to the control circuit mounted on the same circuit receptacle seat. Then, since the circuit wiring can be simplified, assembling efficiency can be improved.

In the electronic timepiece of the present invention, it is preferable that the case body composed of a non-conductive material member for receiving the power-generation mechanism and the time-measuring mechanism therein is provided, and at least a part of the antenna is buried in the case body. Here, a synthetic resin or ceramic, etc. is used as the non-conductive member for the case body.

By such a structure, since the case body made from a synthetic resin, does not shield electromagnetic waves, the receiving strength of the antenna can be ensured. Although a synthetic resin is winferior to a metal in strength, the strength of the case body can be reinforced by burying the antenna in the synthetic resin. Further, by protecting the antenna with synthetic resin, the corrosion resistance of the antenna can be increased. If a synthetic resin is employed, the cost for materials is also cheap, and further, since it is possible to mold the antenna while buried in the case body by injection molding, the cost for fabrication can be reduced.

In the electronic timepiece of the present invention, the rotation axis of the rotary weight and the central axis of the movement are preferably eccentrically placed with respect to each other.

Here, the eccentric placement of the rotation axis of the rotary weight and the central axis of the movement means that the location of the rotation axis of the rotary weight and the central position of the movement are different.

By such a structure, the torque on the rotary weight caused by the movement on the electronic timepiece is more increased compared with the case that the center of the movement is identical with the rotation axis of the rotary weight. Therefore, the rotation energy due to the rotation of the rotary weight is increased, and as a result, the power generation performance of the generator is improved.

Further, if the rotation axis of the rotary weight is eccentrically placed from the center of the movement, there can be a residual portion in the base plate of the movement outside the rotation path of the rotary weight in the radial direction, and a space for installing the antenna can be ensured on the base plate outside the rotation path of the rotary weight. Then, since the antenna can be installed on the base plate, the assembling including the placement of the antenna becomes easy and the fabrication efficiency can be improved.

Further, the base plate is preferably composed of a non-conductive member such as synthetic resin, ceramic, etc., or diamagnetic material such as brass, gold alloy, etc.

Here, the rotation center of the rotary weight and the rotation center of hands for indicating time are preferably different. By such a structure, since the hand axis of the hands and the rotation axis of the rotary weight do not overlap, the clock can be made thin.

In the electronic timepiece of the present invention, the rotary weight and the antenna are preferably away from each other by a predetermined distance along the direction of the rotation axis of the rotary weight.

In such a structure, as well as that the antenna is placed outside the rotation path of the rotary weight, since there is a distance between the antenna and the rotary weight in the direction of the rotation axis of the rotary weight, the antenna can receive even the radio waves whose progressing direction crosses with the rotation axis of the rotary weight. For example, if the antenna and the rotary weight are placed at the same height on the plane almost perpendicularly crossing the rotation axis of the rotary weight, the radio waves crossing the rotation axis of the rotary weight and progressing from the rotation axis side toward the antenna, is shielded by the rotary weight before reaching the antenna. However, according to the present invention, the radio waves crossing the rotation axis of the rotary weight and progressing from the rotation axis side is not shielded by the rotary weight, and reach the antenna, and the antenna can receive the standard radio waves.

Here, if there is installed a back lid on one end surface of the case body which is shaped like a short barrel with the both end faces open, and a letter plate on the other end surface, the rotary weight is installed to the back lid side and the antenna is installed to the letter plate side.

By such a structure, since the antenna and the rotary weight are placed with a predetermined distance therebetween along the direction of the rotation axis of the rotary weight, radio waves are not shielded by the rotary weight, and received by the antenna.

Further, at this time, the back lid is preferably composed of a non-conductive member. And, for example, the back lid is preferably made from inorganic glass such as sapphire glass, etc., or organic glass of polycarbonate, acryl resin, etc. of light permeability and insulating property.

According to such a structure, since the electromagnetic waves reaches the antenna without being shielded by the back lid, standard radio waves can be well received by the antenna. And, if the back lid is made from glass, in addition to the advantage that the non-conductive member does not shield electromagnetic waves, the internal structure of the timepiece can be seen due to the light permeability of glass so as to improve the aesthetic appearance of the timepiece.

The electronic timepiece of the present invention preferably includes a power storage mechanism for storing the power generated by the power-generation mechanism, a driving mechanism driven by the power stored in the power storage mechanism, and hands for time display rotated by the driving force of the driving mechanism.

By such a structure, the power generated by the power-generation mechanism by the rotation of the rotary weight is stored in the power storage mechanism. The driving mechanism is driven by the stored power, and the hands for time display are driven. And, current time clocked by the time-measuring mechanism is displayed by hands. Further, wireless information, for example, the standard radio waves including time information transmitted from a predetermined transmitting station, are received by the antenna, and the time clocked by the time-measuring mechanism is corrected based on the received time information. And, according to the corrected time, the location of the hands is corrected by the driving mechanism.

The electronic timepiece of the present invention preferably includes a mechanical energy storage mechanism for storing the rotation energy generated by the rotation of the rotary weight as mechanical energy, an energy transmission mechanism for transmitting the mechanical energy stored in the mechanical energy storage mechanism to the generator, and coupled with the hands for time display in the path, and a rotation control mechanism for controlling the rotation period of the generator.

Here, the rotation control mechanism is preferably able to control the rotation period by switching between a plurality of periods without being limited to one rotation period.

By such a structure, the energy generated by the rotation of the rotary weight is stored in the mechanical energy storage mechanism. The power stored in the mechanical energy storage mechanism is transmitted to the hands by the energy transmission mechanism so as to display time. The rotation control mechanism controls the rotation period of the generator by time pulses clocked, for example, by the time-measuring mechanism. Since the generator is connected to the energy transmission mechanism, and the rotation of the generator is controlled by the rotation control mechanism, the amount and timing of the energy transmitted from the mechanical energy transmission mechanism to the hands are controlled. Then, the rotation of the hands is in a predetermined period matched to the time-measuring, it displays current time. Further, if controlling plural kinds of periods, multi-functional displays such as chronograph, timer, etc. can be performed. And, by correcting the location of the hands based on the time information included in the wireless information received by the antenna, correct time can be displayed.

Here, the generator preferably includes a pair of rotor circular plates rotated by the mechanical energy by the rotation of the rotary weight and placed diametrically opposite each other with an predetermined distance therebetween in the almost perpendicular direction to the plane including the antenna core of the antenna, magnets oppositely placed on the opposite surfaces of the rotor circular plates, and a power-generation coil placed between the rotor circular plates and having the axial line almost perpendicular to the plane including the antenna core of the antenna.

By such a structure, the magnetic field generated from the power-generation coil of the generator is substantially perpendicular to the antenna core of the antenna. Therefore, since the magnetic flux from the power-generation coil does not follow the antenna core of the antenna, the magnetic field from the power-generation coil is difficult to interfere with the antenna. As a result, wireless information can be well received by the antenna.

Preferably, the generator is placed inside the movement, and the antenna is placed on the peripheral part of the movement. By such a structure, the external magnetic field from the outside of the clock body is shielded by the antenna core of the antenna, and therefore, there is no case that the external magnetic field reaches the generator. Then, since the antimagnetic performance is increased, there is no case that the external magnetic field affects the rotation of the generator, and the time display by hands can be exactly performed.

Here, in the electronic timepiece of the invention, there is provided a band for a wristwatch made from a conductive material, and the projection images of the antenna and the band for the wristwatch are preferably separated each other when projected from the viewing direction of the time display part.

By such a structure, since the antenna and the band for the wristwatch do not overlap, wireless radio waves interlinked to the antenna can be guaranteed, and the receiving sensitivity of the antenna can be highly maintained. If the band for the wristwatch is made from a conductive material, the wireless radio waves can be drawn into the band for the wristwatch, but if the antenna and the band for the wristwatch do not overlap, even if the wireless radio waves can be drawn into the band for the wristwatch, the impact on the interlink magnetic flux of the antenna can be reduced.

The electronic apparatus of the present invention preferably includes a power-generation mechanism having a rotary weight, and a generator for converting the mechanical energy generated by the rotation of the rotary weight into electrical energy, and a receiving mechanism having an antenna for receiving wireless information, and the antenna is preferably installed further towards the outside in the radial direction of the rotary weight than the rotation path of the outer circumferential edge of the rotary weight.

By such a structure, the mechanical energy generated by the rotation of the rotary weight is converted into electrical energy by the power-generation coil. The electronic apparatus can be driven by the power achieved by the power-generation mechanism. If wireless information is received by the antenna, and the wireless information includes, for example, time information, time is displayed based on the time information, and if the wireless information is news, the news can be displayed.

Since the antenna is installed further towards the outside in the radial direction of the rotary weight than the rotation path of the outer circumferential edge of the rotary weight, whichever position the rotary weight takes, there is no case that the antenna and the rotary weight overlap two-dimensionally. Therefore, during the reception of wireless information by the antenna, even if the rotary weight is rotated, the wireless information is not shielded by the rotary weight, and can be received by the antenna.

As described above, the wireless information is not limited to time information, or news, it can include various kinds of information such as, for example, weather reports, time schedules of trains, etc.

BEST MODE FOR CARRYING OUT THE INVENTION

Preferred embodiments of the present invention will be described below with reference to the drawings.

First Embodiment

Figure 1:
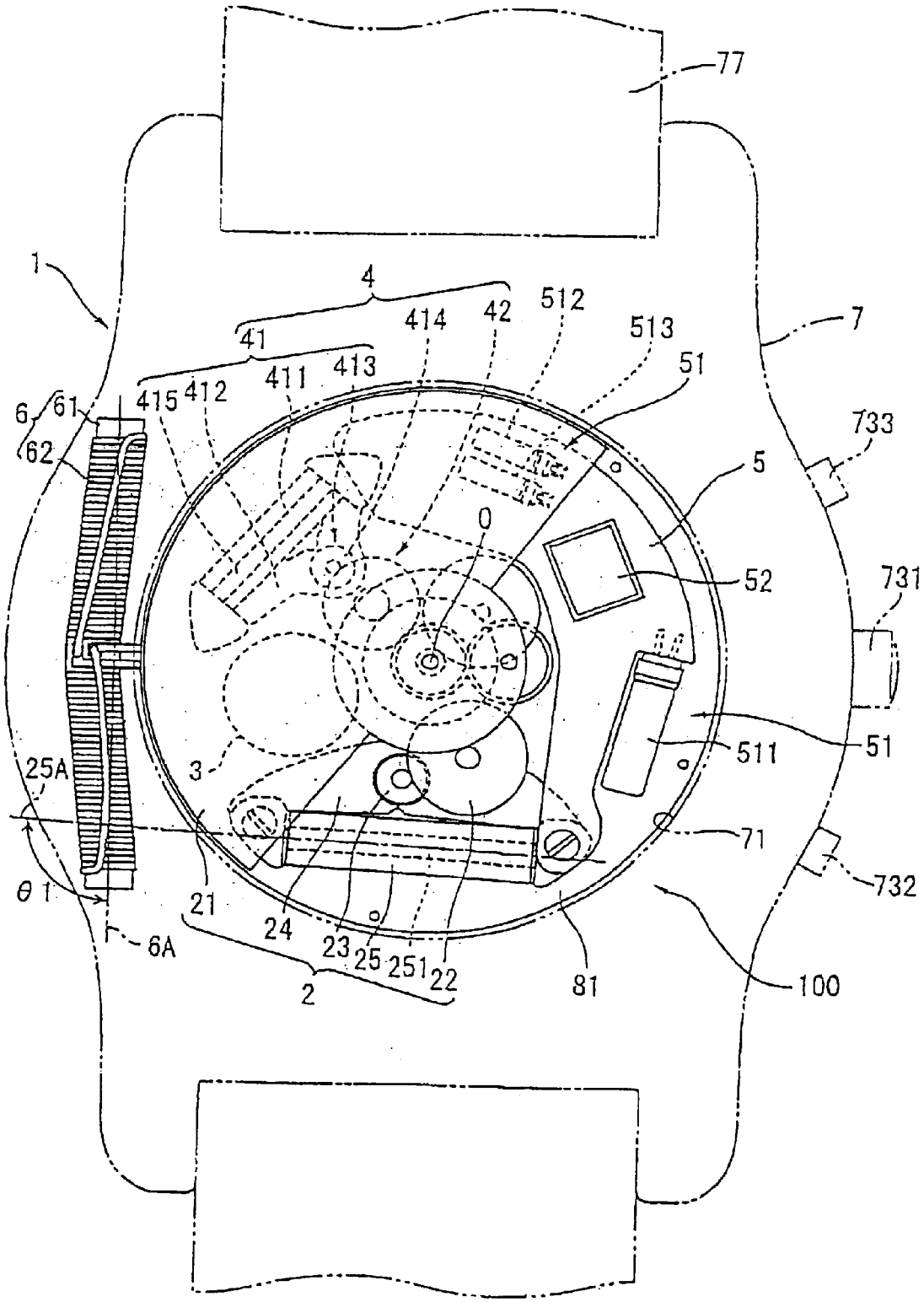
FIG. 1 is a view illustrating the internal structure with a back lid removed off according to a first embodiment of the present invention.
Figure 2:
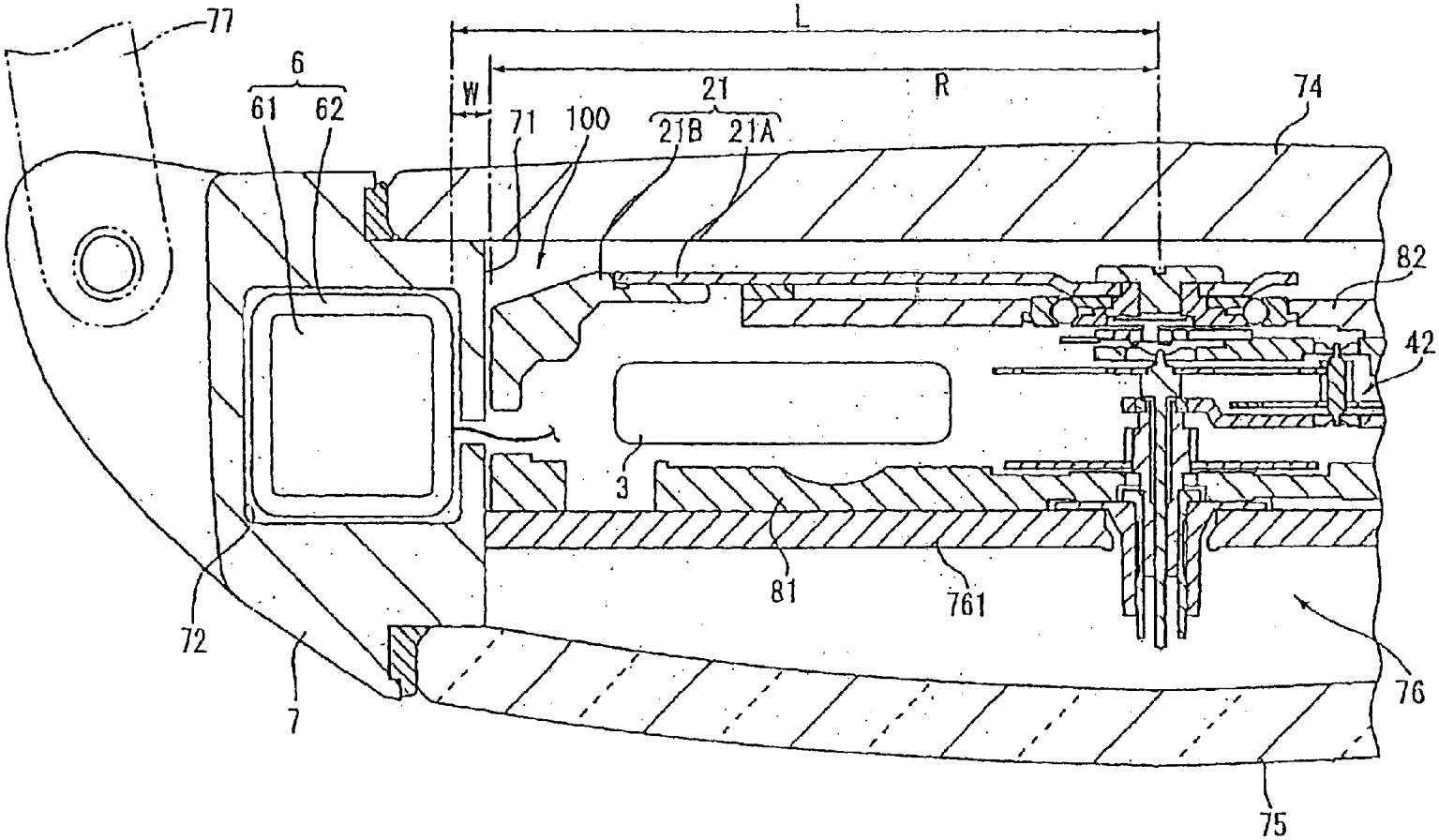
FIG. 2 is a cross-sectional view illustrating main parts of the first embodiment.

FIG. 1 illustrates a wristwatch typed radio wave clock according to an electronic timepiece of a first embodiment of the present invention. FIG. 1 is a plane view of the radio wave clock with a back lid of the radio wave clock removed. FIG. 2 is a cross-sectional view of the main parts of FIG. 1. Incidentally, in FIG. 1, it is assumed that the lower part of the drawing sheet is at the 6 o'clock direction, the upper part is at the 12 o'clock direction and right part is at the 3 o'clock direction. the drawing sheet is a 6 o'clock direction, downside is a 12 o'clock direction, and right is a 3 o'clock direction.

A radio wave clock 1 includes a body case 7, a movement 100 for clock placed inside the body case 7, and an antenna 6 for receiving standard radio wave including time information as wireless information.

The body case 7 is substantially ring-shaped, and made from nonconductive material such as ceramic and synthetic resin, or diamagnetic material such as brass, gold, and gold alloy. The body case 7 also includes attaching portions on the peripheral two opposite locations respectively for attaching a wristwatch band 77.

A time display portion 76 is provided on one end face side of the body case 7, and a windshield 75, being made from a nonconductive glass (sapphire glass, etc.), is also fittingly provided from the outside of the time display portion 76 (reference to FIG. 2). The time display portion 76 includes a clock face 761 installed inside the ring of the body case 7, and hands (not shown) rotating above the clock face 761.

A substantially circular shaped concave portion 71 is formed by the back surface of the substantially circular shaped clock face 761 and the inner wall of the body case 7. The concave portion 71 is open toward the back side of the time display portion 76, and the movement 100 for clock is provided in the concave portion 71. As shown in FIG. 2, the concave portion 71 is covered by the back lid 74. Further, the clock face 761 and the back lid 74 preferably include a portion made from nonconductive member (ceramic, synthetic resin, etc.).

As shown in the cross-sectional view of FIG. 2, a receiving space 72 for receiving the antenna 6 therein is formed in the body case 7 by hollowing it. The receiving space 72 and the concave portion 71 are connected with each other by a connection passage so that the wiring from the antenna 6 can be connected to the movement 100.

An external manipulation mechanism 73 is installed on the body case 7 in the about three o'clock direction. The external manipulation mechanism 73 includes a crown 731 provided to allow three stages positions to be adjusted into, that is, 0 stage, 1 stage, and 2 stage, and a first switch 732 and a second switch 733 installed on the both sides of the crown 731 respectively.

The movement 100 for clock includes a power-generation system 2 is a power-generation mechanism, a secondary battery 3 for storing power generated by the power-generation system 2, a driving portion 4 to be driven by using the secondary battery 3 as a power source, a circuit block 5 having a crystal oscillator 51, a control IC 52, and the like, and a base plate 81 and a wheel train bridge 82 for supporting and integrating these elements.

The power-generation system 2 includes a rotary weight 21 being a semicircular-shaped plate and being rotatable such that the center of rotation is supported by the movement 100 through a ball bearing, a power transmission part 22 for transmitting mechanical energy by the rotation of the rotary weight 21 through a gear train, and a generator for generating electricity by the power transmitted by the power transmission part 22. The generator is a typical generator which includes a power-generation rotor 23 rotated by the power transmitted by the power transmission part 22, a power-generation stator 24 (usage of a permalloy material), and a power-generation coil 25.

The rotary weight 21 is composed of a substantially semicircular-shaped conductive member with the center of rotation and centroid eccentrically placed, and specifically, includes a wrist part 21A being thin plate-shaped with a rotation axis part, and a heavy weight part 21B fixed on the peripheral portion of the wrist part 21A as shown in FIG. 2. The heavy weight part 21B is made from a material having a high specific gravity such as a tungsten alloy or gold alloy, and generates sufficient energy for the power generation by rotation. The wrist part 21A and the heavy weight part 21B may be integrally formed.

The power-generation rotor 23 includes a circular-shaped magnet having two poles or more.

The secondary battery 3 has a typically known configuration, and its case (outer can) is made from a ferromagnetic metal. The ferromagnetic metal for the case (outer can) includes, for example, SUS 304, or the like.

The driving portion 4 includes a motor 41 for driving hands as a stepping motor for driving hands (not shown) of the time display portion 76, and a wheel train part 42 for transmitting the power of the motor 41 for driving hands to the hands.

The motor 41 for driving hands includes a motor coil 411 wound around a rod-shaped coil core 415, a motor stator 412 that is being plate-shaped and transmits a magnetic field generated from the motor coil 411, and a motor rotor 413 rotatably placed within a hole opening of motor stator 412, and rotated by the induced magnetic field. A rotor magnet 414 of the motor rotor 413 is preferably made from a rare-earth magnet magnetized into two or more poles, for example, the samarium cobalt group. The motor rotor 413 is engaged with the wheel train part 42.

The rod-shaped coil core 415 and the plate-shaped motor stator 412 of motor 41 for driving hands are composed of a high magnetic permeability material, such as a permalloy material.

The gear axis of the gear train of the wheel train part 42 is mainly made from a steel material such as carbon steel or stainless steel.

The circuit block 5 is composed of the crystal oscillator 51 for oscillating with a predetermined period, and control IC 52.

The crystal oscillator 51 includes a crystal oscillator 511 for oscillating a reference clock for measuring time, and crystal oscillators 512, 513 for tuning for generating tuning signals tuned to the frequency of the standard radio waves. The crystal oscillators for tuning are a crystal oscillator 513 to be tuned to the standard radio waves of 60 kHz, and a crystal oscillator 512 to be tuned to the standard radio waves of 40 kHz, for example, in Japan. Further, crystal oscillators for 60 kHz of standard radio waves and 77.5 kHz of standard radio waves are used, for example, in Europe and America.

The control IC (Integrated Circuit) 52 includes a dividing circuit for dividing the frequency from the crystal oscillator 51 and generating a reference clock, a time-measuring circuit for counting a reference clock and measuring time, a control circuit for controlling the motor 41 for driving hands based on the signal from the time-measuring circuit, a receiving circuit for processing (amplification, demodulation) the time information received by the antenna 6, or the likes. The control IC 52 may be formed by commonly using available circuit portions, or may be software-based using a computer, etc., rather than an analog circuit. Here, the time-measuring mechanism includes the crystal oscillator 51, the dividing circuit, and the time-measuring circuit.

The base plate 81 is substantially circular plate-shaped, and is composed of a nonconductive member (for example, plastic) or a diamagnetic material (for example, brass), and is installed in the concave portion 71 of the body case 7, and screw-coupled on the clock face 761. And, the power-generation system 2, the secondary battery 3, the driving part 4, the crystal oscillator 51, and the circuit block 5 are installed on the base plate 81.

The wheel train bridge 82 is installed on the side to the back lid 74. The power-generation system 2, the secondary battery 3, the driving part 4, the crystal oscillator 51 and the circuit block 5 are tightly placed between the base plate 81 and the wheel train bridge 82. Further, the wheel train bridge 82 is made from the same material as the base plate 81.

The antenna 6 includes a rod-shaped antenna core 61, being made from ferrite, and an antenna coil 62 wound around the antenna core 61. The antenna 6 is received inside the receiving space 72 of the body case 7. The time information (wireless information) received by the antenna 6 is output to the receiving circuit of the control IC 52 for signal processing. Here, a receiving mechanism is composed of the antenna 6 and the receiving circuit of the control IC 52.

Further, as the time information received by the antenna 6, for example, a long wave standard radio wave (JJY) can be used.

Now, the configuration layout of the radio wave clock 1 will be explained.

The antenna 6 is placed further towards the outside in the radial direction of the rotary weight 21 than the rotation path of the outer circumferential edge of the rotary weight 21. In other words, the antenna 6 is placed such that the distance L from the center O of rotation and the inner side surface of rotation of the antenna 6 facing the center of rotation is larger than the radius R of rotation from the center 0 of rotation to the rotation path of the rotary weight 21. Further, in this embodiment, the antenna 6 is placed such that there exists a gap W between the antenna 6 and the rotary weight 21.

As shown in FIG. 1, when the radio wave clock 1 is seen two-dimensionally from its back lid 74 side, the antenna 6 is placed such that the central axis 6A of the antenna 6, that is, the central axis of the antenna core 61 is crossed with the central axis 25A of the power-generation coil 25 at an angle θ1 that is about 90°.

Further, if the watch band 77 is made from a material including a conductive substance such as SUS (stainless steel), titanium alloy, gold alloy, and brass, the antenna 6 and the watch band 77 are preferably placed so as not to overlap with each other two-dimensionally. In case that the watch band 77 made from a conductive material, standard radio waves are also drawn by the watch band 77, but in the above structure, because the antenna 6 and the watch band 77 do not overlap each other, it is possible to reduce the influence that the watch band 77 otherwise gives against the interlink magnetic flux of the antenna Here, the two ends of the coil core 251 (made from a permalloy material) of the power-generation coil 25 are preferably placed along the peripheral part of the base plate 81. Accordingly, since the total length of the rod-shaped coil core 251 can be lengthened, and the number of turns of the coil can be increased, the power generation performance can be improved. And, if the antenna 6 and the power-generation coil 25 are crossed with each other at the angle θ1 that is about 90°, the malfunctioning during the reception of the radio waves can be prevented even with the increase of the total length of the coil core 251.

In the planar placement, the secondary battery 3 and the motor 41 for driving hands are placed between the antenna 6 and the power-generation coil 25. The case of the secondary battery 3, and the coil core 415 of the motor 41 function as a magnetic field shielding member to prevent the magnetic flux generated by the power-generation coil 25 from flowing through the antenna 6, and therefore, a magnetic field shielding means is composed including these two members.

That is, in this embodiment, the magnetic field shielding means mainly includes the case of the secondary battery 3, and the coil core 415 of the motor 41, but the metallic parts such as the wheel train part 42 or the gear train of the power transmission part 22, placed between the antenna 6 and the power-generation coil 25, and the rotary weight 21 also work as the magnetic field shielding means.

Further, the placement of the magnetic field shielding members (magnetic field shielding means) between the antenna 6 and the power-generation coil 25 means that the magnetic field generated by the power-generation coil 25 is shorter in the magnetic circuit closed through the magnetic field shielding member than in the magnetic circuit closed through the antenna 6. That is, it means that the distance between the two ends of the magnetic field shielding means composed of the secondary battery 3, the motor 41 for driving hands, etc., is shorter than the distance between the two ends of the power-generation coil 25 and the two ends of the antenna 6.

By the structure as above, if wearing the radio wave clock 1 on an arm and shaking the arm, the rotary weight 21 is rotated. Then, the mechanical energy by the rotation of the rotary weight 21 is transmitted to the power-generation rotor 23 through the gear tram of the power transmission part 22, the power-generation rotor 23 is rotated. If the power-generation rotor 23 is rotated, the change of the magnetic field in the power-generation stator 24 occurs so that the induced current is generated in the power-generation coil 25 by the change of the magnetic field. The induced current is stored in the secondary battery 3. By the stored current, the crystal oscillator 51, the control IC 52, and the motor 41 for driving hands are driven.

When voltage is applied to crystal oscillator 51, an oscillating signal is output and divided by the dividing circuit of the control IC 52 so as to generate a reference signal. Based on the reference signal, the time is clocked by the time-measuring circuit of the control IC 52 and the motor 41 for driving hands is driven so as to rotate the motor rotor 43. The rotation of the motor rotor 43 is transmitted to the hands by the wheel train part 42 so as to display the time.

If the-time information is received by the antenna 6, the time clocked. i.e. measured by the time-measuring circuit of the control IC 52 can be corrected based on the time information, and the corrected time is displayed by the hands.

Next, the operation of the radio wave clock 1 will be explained.

There are three operation modes, that is, a time display mode at a crown 0 stage, a manual time-correcting mode-at a crown 1 stage, and a hand 0-position correcting mode at a crown 2 stage.

In the time display mode at the crown 0 stage, the current time is normally displayed. If the first switch 732 is pressed for more than 2 seconds in this stage, the time display mode is moved to a forced receiving mode of standard radio waves, and the standard radio waves are received. If the reception is completed, the time is corrected based on the received time information, and then, the operation mode is moved to a normal operation. Even in the case that the reception of the standard radio waves is not successful, the clock can move to the normal operation based on a normal counter for current time. Further, if the second switch 733 is pressed, the former mode is moved into a receiving confirmation mode. In the receiving confirmation mode, if the reception has been successfully done within the immediately preceding several hours, a second hand is moved to a 30 second position (it indicates the number "6" on the clock face 761) as a signal of the successful reception. If the reception has not been successful, the moving of the hand is stopped. The receiving confirmation mode lasts for 5 seconds, and then moves to the normal operation.

In the manual time-correcting mode of the crown 1 stage, if the first switch 732 is pressed once, the second hand advances by one scale, and if the first switch 732 is kept pressed for a predetermined time, the second hand is forwarded at a pulse rate of 128 Hz. If the second switch 733 is pressed once, the minute hand is forwarded by one scale, and if the second switch 733 is kept pressed for a predetermined time, the minute hand is forwarded at a pulse rate of 128 Hz.

In the hand 0-position correcting mode of the crown 2 stage, if the first switch 732 is pressed, the second hand goes back to 0 (zero). Further, if the second switch 733 is pressed, the minute hand goes back to 0 (zero).

The effect of the configuration structured as above according to the first embodiment will be explained, as follows.

(1) Since the antenna 6 is placed away from the center O of rotation of the rotary weight 21 beyond the rotation radius R of the rotary weight 21, the rotary weight 21 and the antenna 6 do not overlap two-dimensionally even if the rotary weight 21 is rotated and placed at any location. Therefore, there the situation where the time information received by the antenna 6 is cut off does not occur no matter what position the rotary weight 21 takes, and the antenna 6 can receive the time information regardless of the location of the rotary weight 21. That is, the antenna 6 can receive time information while the power is generated by the power-generation system 2 having the rotary weight 21.

(2) The antenna 6 is placed such that the central axis 6A of the antenna core 61 of the antenna 6 is crossed with the central axis 25A of the power-generation coil 25 at the angle 01 that is about 90°. Therefore, even if the magnetic field is generated from the power-generation rotor 23 by the rotation of the rotary weight 21 in the middle of the reception of time information by the antenna 6, the magnetic flux of the magnetic field rarely overlaps the antenna 6 since the magnetic flux of the magnetic field is substantially perpendicular to the antenna coil 62 of the antenna 6. As a result, the impact of the magnetic field from the power-generation coil 25 on the antenna 6 can be reduced, the erroneous reception is eliminated, and the receiving sensitivity of the antenna 6 can be improved.

(3) Since the magnetic field shielding member such as the secondary battery 3 or the motor 41 for driving hands, etc. is placed between the antenna 6 and the power-generation coil 25, the magnetic flux of the magnetic field generated from the power-generation coil 25 easily forms a closed loop by passing through the secondary battery 3 or the motor 41 for driving hands, and coming back to the power-generation coil 25 before reaching the antenna 6. Particularly, since the coil core 415 of the motor 41 for driving hands and the motor stator 412 made from a material of high magnetic permeability such as a permalloy material, more magnetic flux can pass through the medium of high magnetic permeability 50 that the magnetic flux reaching the antenna 6 can be reduced. Therefore, since it becomes difficult for the magnetic field from the power-generation coil 25 to reach the antenna 6, the impact of the magnetic field from the power-generation coil 25 on the antenna 6 can be reduced, and the receiving sensitivity of the antenna 6 can be much more improved. Further, since the gear axes of the power transmission part 22, the wheel train part 42, the rotary weight 21, or the like are made from a steel material such as carbon steel or stainless steel, etc., the magnetic field from the power-generation coil 25 can be also shielded by these steel members so as not to reach the antenna 6.

Since these magnetic field shielding members are the components of the radio wave clock 1, no new additional components for shielding the magnetic field is necessary to be incorporated, and since the effect of the magnetic field shielding can be achieved by just the adjustment of the planar layout of the antenna 6, the secondary battery 3, the motor 41 for driving hands, and the power-generation coil 25, the increase of the number of components can be suppressed, and the cost increase and the decrease of productivity can be prevented.

(4) Since the antenna core 61 is made from ferrite, a magnetic substance, the magnetic field penetrating from the outside of the radio wave clock 1 is drawn into the antenna core 61, and does not penetrate into the inside of the radio wave clock 1. Therefore, it is prevented that the magnetic field out of the radio wave clock 1 penetrates into the inside of the magnetic circuit of the motor 41 for driving hands, and the motor 41 for driving hands malfunctions by the external magnetic field.

(5) Since the magnetic field shielding members make it difficult for the magnetic field from the power-generation coil 25 to reach the antenna 6, the magnetro-striction of the antenna core 61 of the antenna 6 can be suppressed. Therefore, the progression of the internal destruction of the antenna 6 by the magnetro-striction can be suppressed, and the lifetime of the antenna 6 can be lengthened.

Since the expansion and the contraction of the antenna core 61 due to the magnetro-striction can be suppressed, the friction of an electrically insulating covering film on the surface of the antenna coil 62 and the antenna core 61 can be prevented. Therefore, the electrically insulating state between the antenna coil 62 and the antenna core 61 can last long.

Second Embodiment

Figure 3:
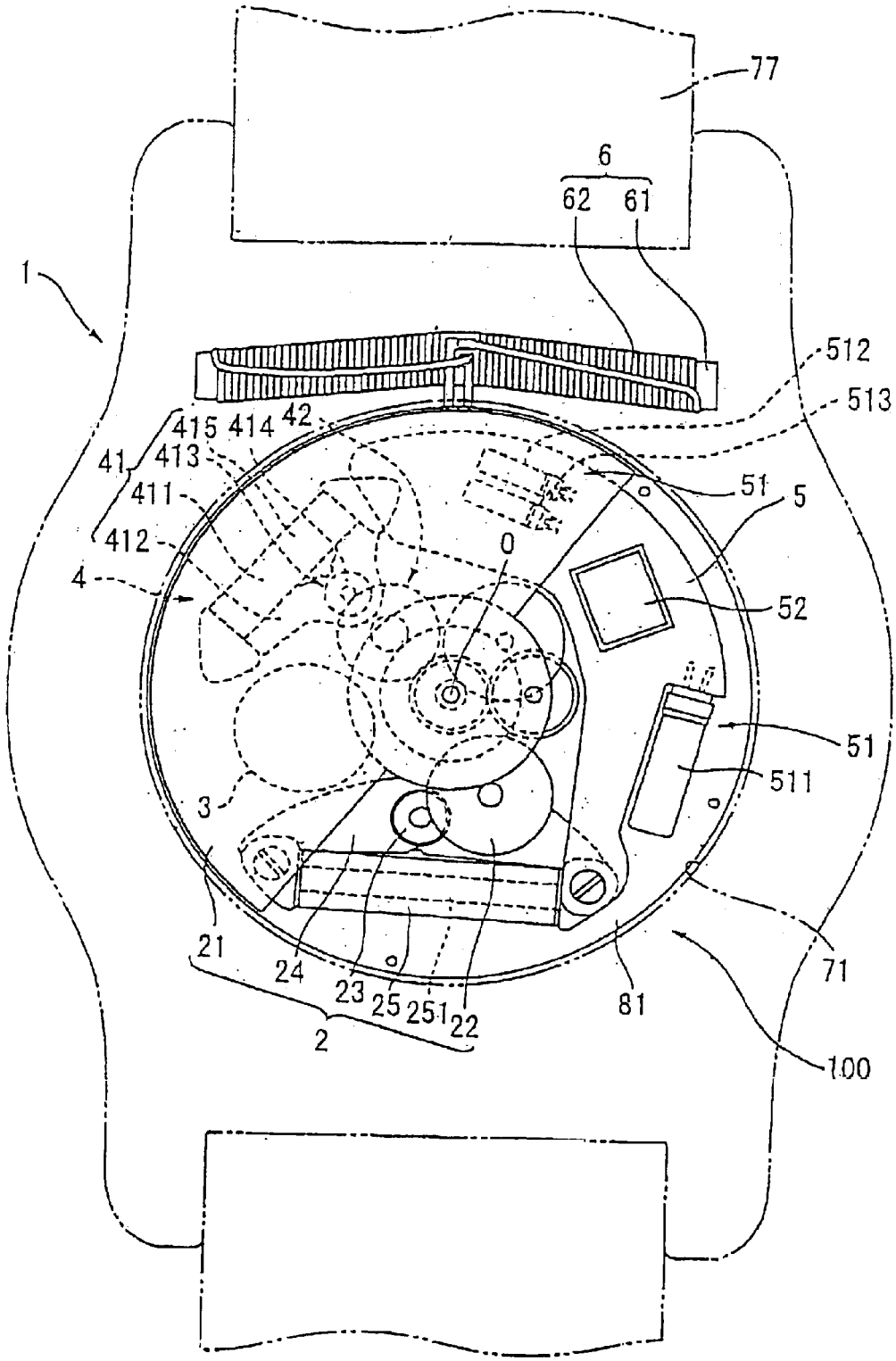
FIG. 3 is a view illustrating the internal structure with a back lid removed off according to a second embodiment of the present invention.

FIG. 3 illustrates a radio wave clock 1 according to the electronic timepiece of a second embodiment of the present invention. The radio wave clock 1 has basically the same structure as that of the first embodiment, but the structure of the second embodiment is different from that of the first embodiment in the placement of the antenna 6, the secondary battery 3, the power-generation coil 25, and the motor coil 411.

In this embodiment, the antenna 6 and the power-generation coil 25 are placed diametrically opposite with respect to the center O of rotation of a rotary weight 21. And, in the structure of the radio wave clock 1, the antenna 6 and the power-generation coil 25 are preferably placed furthest away from each other.

The secondary battery 3 and a motor 41 for driving hands are placed between the antenna 6 and the power-generation coil 25. Coil core 415 of the motor coil 411 and the case of the secondary battery 3 form magnetic field shielding means. The magnetic field shielding means is mainly composed of the coil core 415 of the motor coil 411 and the case of the secondary battery 3, and also includes a gear train such as wheel train part 42 or a power transmission part 22 placed between the antenna 6 and the power-generation coil 25, and metallic parts such as the rotary weight 21. Because of this, the magnetic circuit of the magnetic field generated from the power-generation coil 25 is configured to be closed through the coil core 415 of the coil 411 for motor, the secondary battery 3, and the gear train without passing the antenna 6.

Preferably, coil core 251 of the power-generation coil 25 is rod-shaped, and both the two ends of the coil core 251 are placed along the outer circumferential edge of a base plate 81. Accordingly, the antenna 6 and the power-generation coil 25 are placed on the opposite sides each other with respect to the center O of rotation of the rotary weight 21, that is, furthest away from each other in the structure. Further, since the coil core 251 of the power-generation coil 25 is rod-shaped, and both two ends of the coil core 251 are placed along the outer circumferential edge of the base plate 81, the number of turns of the power-generation coil 25 is possibly increased to improve the performance of power generation. Further, to improve the performance of power generation, the power-generation coil 25 may be wound along the peripheral shape of the base plate.

Incidentally, it is the same as in the first embodiment that the antenna 6 is placed outside the diameter of the rotation path of the rotary weight 21.

The effects achieved by such a structure are as follows in addition to the effects (1), (3), (4), and (5) of the first embodiment.

(6) Since the antenna 6 and the power-generation coil 25 are placed on the opposite sides to each other with respect to the center O of rotation of the rotary weight 21, that is furthest away from each other in the structure, it is difficult for the magnetic field generated from the power-generation coil 25 to reach the antenna 6. Because of this, the antenna 6 is hardly affected by the magnetic field generated from the power-generation coil 25 during reception, and thus erroneous receptions can be suppressed.

Third Embodiment

Figure 4:
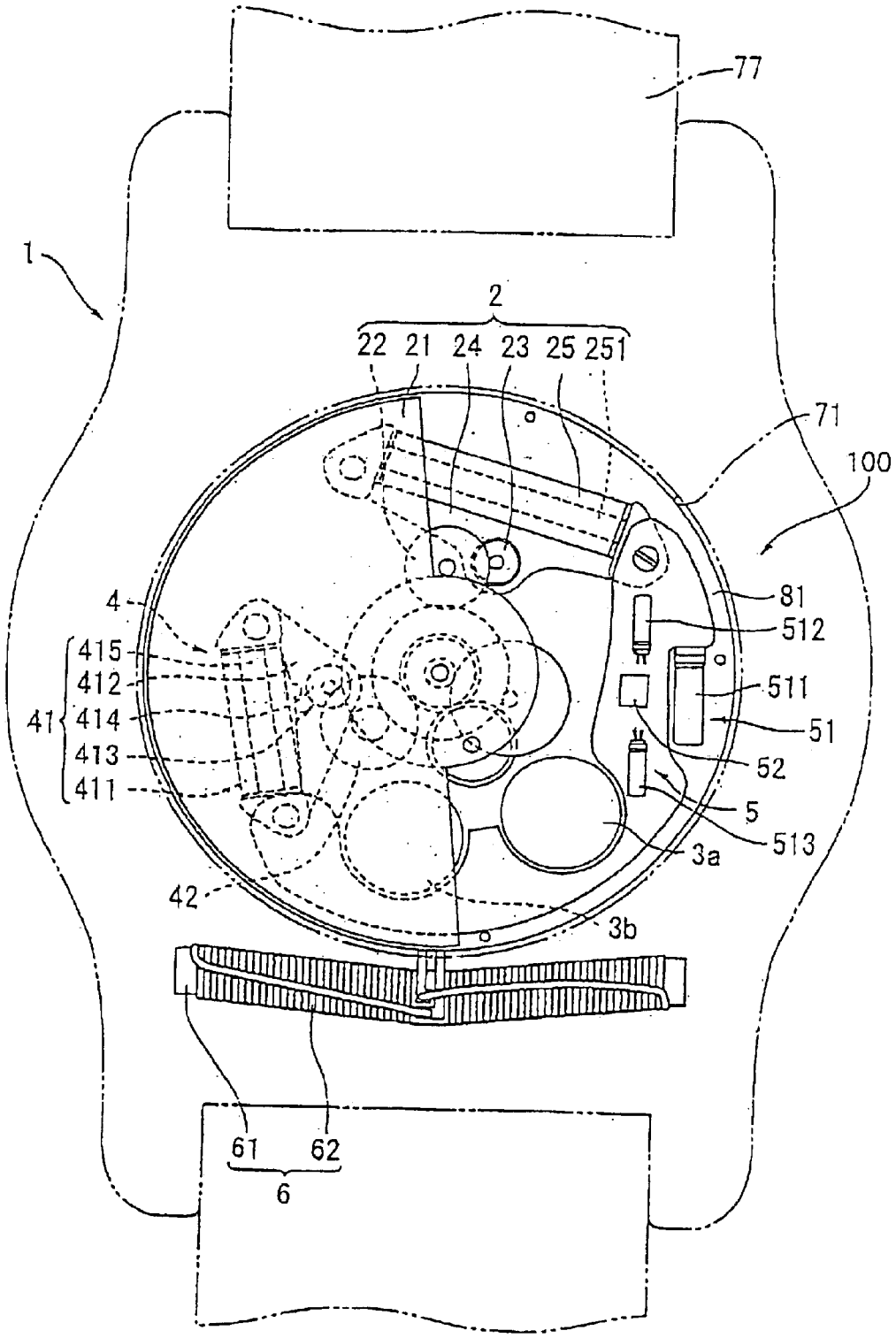
FIG. 4 is a view illustrating the internal structure with a back lid removed off according to a third embodiment of the present invention.

FIG. 4 illustrates a radio wave clock 1 according to the electronic timepiece of a third embodiment of the present invention. The radio wave clock 1 has basically the same structure as that of the second embodiment, but the structure of the third embodiment is different from that of the second embodiment as follows.

That is, the second embodiment has a structure in which only one secondary battery 3 is installed, but two secondary batteries 3*a*, 3*b* are installed in the third embodiment. And, between a power-generation coil 25 and an antenna 6, there are installed the two secondary batteries 3*a*, 3*b* and a motor 41 for driving hands.

Therefore, the magnetic field shielding means mainly includes coil core 415 of motor coil 411, and each case of the secondary batteries 3*a*, 3*b*, and also includes the sear train such as a wheel train part 42 or a power transmission part 22 placed between the antenna 6 and the power-generation coil 25, and metallic parts such as a rotary weight 21, which is the same as in the above embodiments. Because of this, a magnetic circuit of the magnetic field generated from the power-generation coil 25 is configured to be closed through a coil core 415 of a coil 411 for motor, the secondary batteries 3*a*, 3*b*, the gear train, etc., without passing the antenna 6.

The effects achieved by such a structure are as follows in addition to the effects (1), (3), (4), (5), and (6) of the above embodiments.

(7) Since two secondary batteries 3*a*, 3*b* and the motor coil 411 are placed between the antenna 6 and the power-generation coil 25, the total length of the magnetic field shielding means can be lengthened more than in each above embodiment, and it is much easier to form a closed loop in which the magnetic flux of the magnetic field generated from the power-generation coil 25 passes through the secondary batteries 3a, 3b and the coil 411 for motor, and again comes back to the power-generation coil 25. Therefore, the magnetic field shielding effects can be more improved by the magnetic field shielding means, and the impact of the magnetic field from the power-generation coil 25 on the antenna 6 can be mare reduced.

Fourth Embodiment

Figure 5:
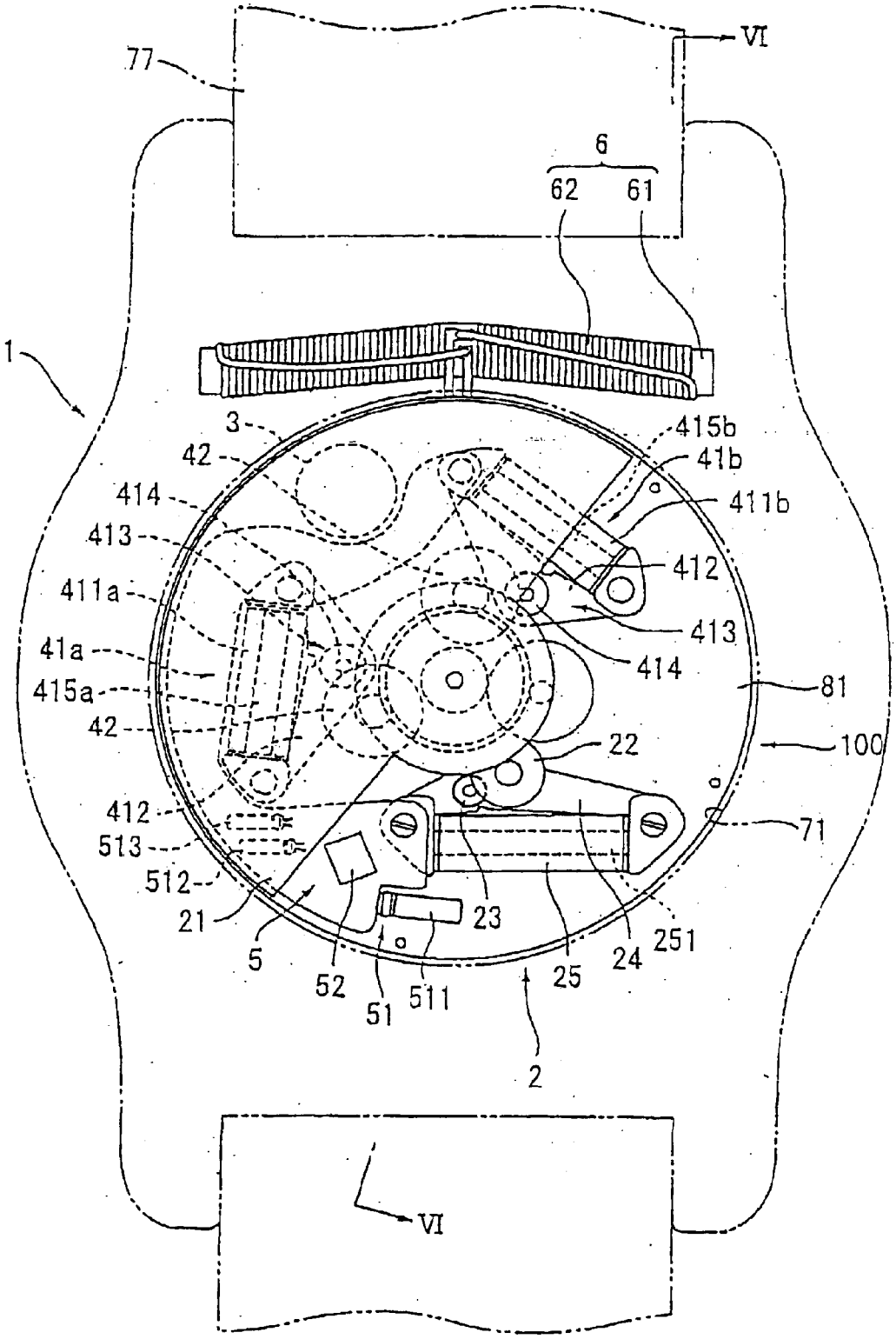
FIG. 5 is a view illustrating the internal structure with a back lid removed off according to a fourth embodiment of the present invention.
Figure 6:
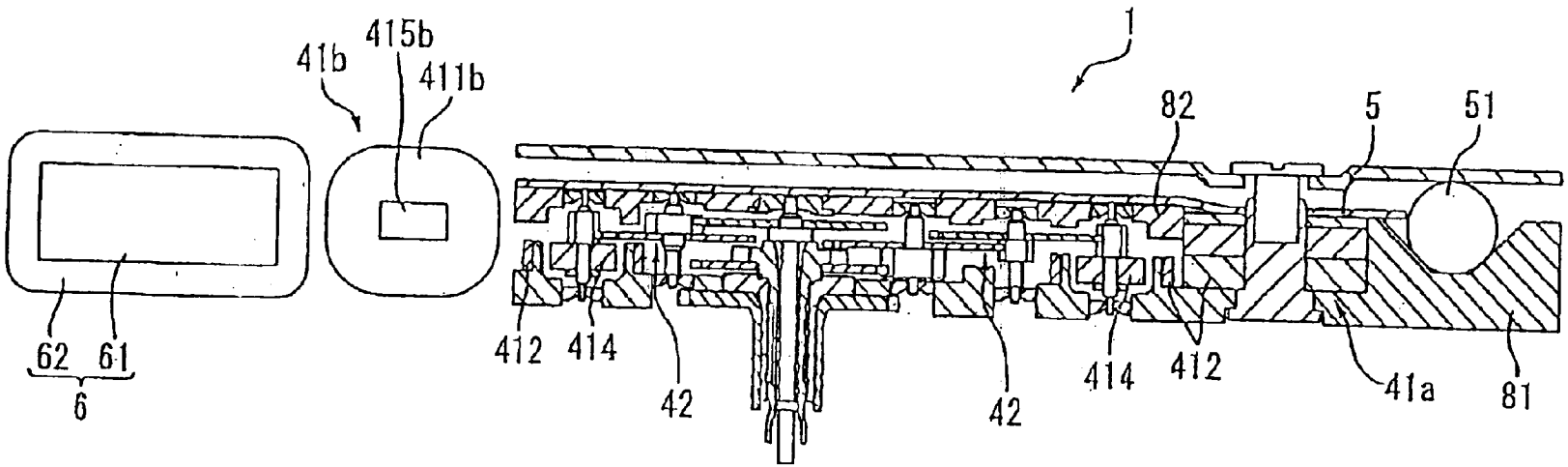
FIG. 6 is a cross-sectional view taken along the line VI—VI of FIG. 5 according to a fourth embodiment.

FIG. 5 illustrates a radio wave clock 1 according to the electronic timepiece of a fourth embodiment of the present invention. FIG. 6 is a cross-sectional view of FIG. 5 taken along the line VI—VI. The radio wave clock 1 has basically the same structure as that of the second embodiment, but the structure of the fourth embodiment is different from that of the second embodiment as follows.

That is, the second embodiment has a structure in which only one motor 41 for driving hands is installed, but two motors 41*a*, 41*b* for driving hands are installed in the fourth embodiment.

Between power-generation coil 25 and antenna 6, there are installed secondary battery 3 and the two motors 41*a*, 41*b* for driving hands. The motors 41*a*, 41*b* for driving hands are a motor for driving the second hand and a motor for driving the hour/minute hands.

The secondary battery 3 is installed adjacent to the antenna 6, particularly, along the long sides of the antenna 6, not along both ends of the antenna 6.

The magnetic field shielding means mainly includes each coil core 415*a*, 415*b* of motor coils 411*a*, 411*b*, and the case of the secondary battery 3, and also includes a gear train such as a wheel train part 42 or a power transmission part 22 placed between the antenna 6 and a power-generation coil 25, and the metallic parts such as a rotary weight 21, which is the same as in the above embodiments.

Figure 7:
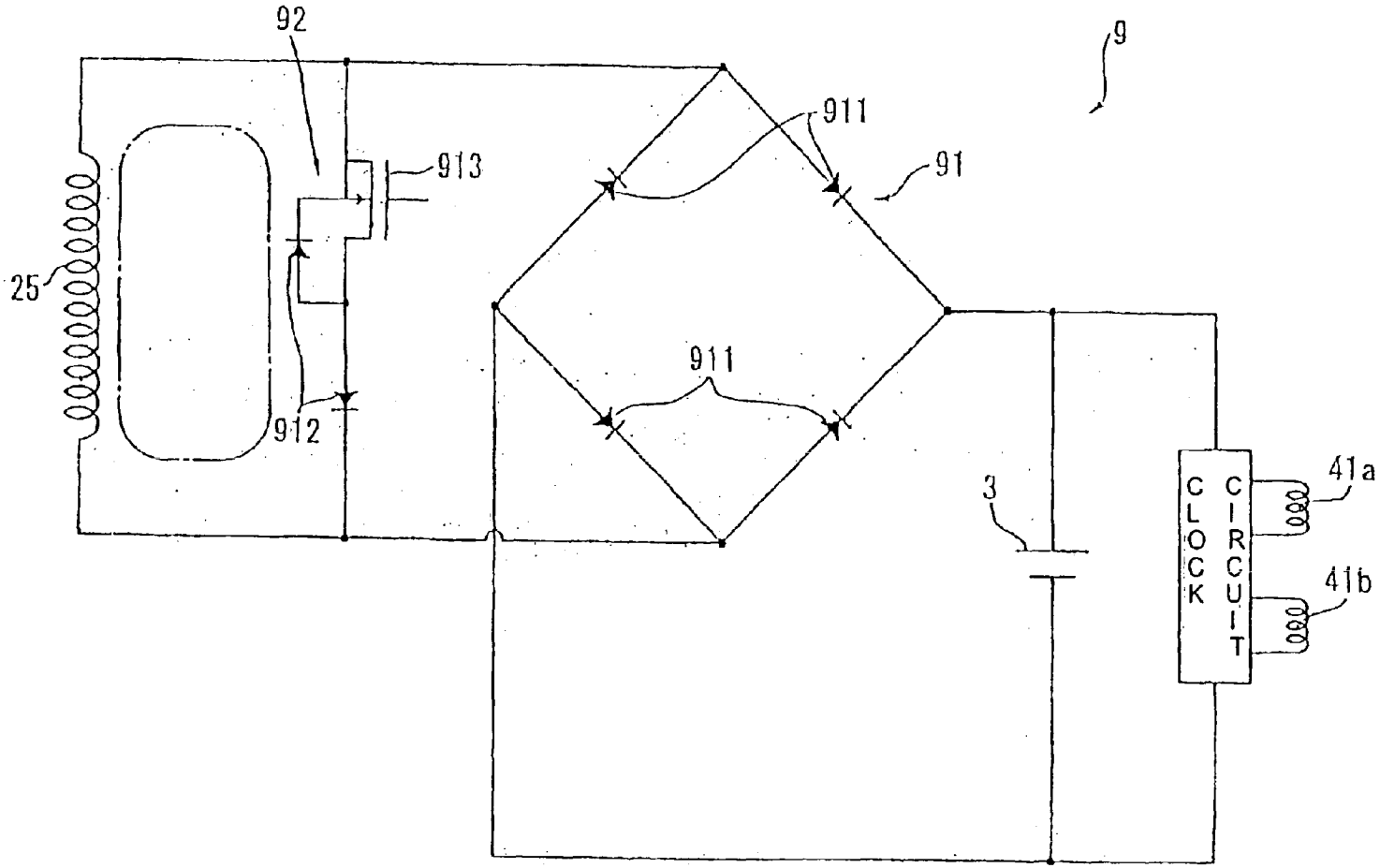
FIG. 7 is a circuit diagram from a power-generation coil to a secondary battery according to the fourth embodiment.

FIG. 7 illustrates a circuit 9 for storing the power generated by a power-generation mechanism 2 into the secondary battery 3.

The circuit 9 is configured to include the power-generation coil 25 of a generator, a rectifier circuit 91 for rectifying the power generated by the power-generation coil 25, the secondary battery 3 for storing the rectified power, and an overcharge preventive circuit 92 installed between the power-generation coil 25 and the rectifier circuit 91 for preventing the overcharge of the secondary battery 3. Further, connected to the secondary battery 3 is a clock circuit which is driven by the power stored in the secondary battery 3 and includes a counter for current time, a motor driver, etc., and the clock circuit is connected to the motors 41*a*, 41*b* for driving hands.

The rectifier circuit 91 is composed of a bridge circuit which is connected to the power-generation coil 25. The bridge circuit comprises four diodes 911 serially connected in a rectangle shape, and each side of the bridge circuit with respect to a diagonal line of the rectangle shape is connected to the power-generation coil 25, respectively. The power generated in the power-generation coil 25 is full-wave rectified by the rectifier circuit 91, and the rectified power is stored in the secondary battery 3.

The overcharge preventive circuit 92 is configured to include two diodes 912, which are connected in series with their forward directions reversed to each other, and limiter switch means 913, which is connected to one of the two diodes 912 in parallel.

The limiter switch means 913 is composed of, for example, a field effect transistor (MOS-FET). The limiter switch means 913 normally takes its off-state to flow the current generated by the power-generation coil 25 to the rectifier circuit, but takes its on-state to short-circuit the both ends of the power-generation coil 25 if the stored voltage in the secondary battery 3 exceeds a threshold voltage.

Further, when the antenna 6 receives the standard radio wave, the limiter switch means 913 takes its on-state so as to short-circuit the both ends of the power-generation coil 25. If the both ends of the power-generation coil 25 are short-circuited, the charging of the secondary battery 3 stops.

The effects achieved by such a structure are as follows in addition to the effects (1), (3), (4), (5), and (6) of the above embodiments.

(8) Since the secondary battery 3 and the motor coils 411*a*, 411*b* are placed between the antenna 6 and the power-generation coil 25, the total length of the magnetic field shielding means can be lengthened more than in each above embodiment, and it is much easier to form a closed loop in which the magnetic flux of the magnetic field generated from the power-generation coil 25 passes through the secondary battery 3 and the coil cores 415*a*, 415*b* of the motor coils 411*a*, 411*b*, and again comes back to the power-generation coil 25. Therefore, the magnetic field shielding effects of the magnetic field shielding means can be more improved, and the impact of the magnetic field from the power-generation coil 25 on the antenna 6 can be much more reduced. Particularly, since each of the coil cores 415*a*, 415*b* is longer than the secondary battery, the total length of the magnetic field shielding means in this embodiment can be lengthened more than the case of the third embodiment in which there are provided two secondary batteries 3*a*, 3*b* and one motor 41, the magnetic field shielding effects also can be much more improved.

(9) The limiter switch means 913 is installed in the overcharge preventive circuit 92, and the limiter switch means 913 takes its on-state during the reception of the standard radio wave by the antenna 6 so that the charging of the secondary battery 3 stops. If the charging of the secondary battery 3 is carried out, a magnetic field is generated by the charging of the electric field of the battery, which is thought to affect the reception of radio waves by the antenna 6. However, in this embodiment, since the storage of the secondary battery 3 stops during the reception of radio waves by the antenna 6, any impact of the magnetic field from the secondary battery 3 on the reception of radio waves is prevented so that the receiving sensitivity of the antenna 6 can be improved. Because of the fact that the secondary battery 3 has no impact on the reception of radio waves by the antenna 6, layout flexibility can be increased, such as installing the secondary battery 3 adjacent to the antenna 6 as shown in FIG. 6. Further, by installing the secondary battery 3 adjacent to the antenna 6, the secondary battery 3 can form the magnetic field shielding means. Incidentally, since the reception of radio waves by the antenna 6 takes only several minutes to dozens of minutes a day, even if the charging stops for that period of time, the charging amount of the secondary battery 3 is hardly affected.

(10) The secondary battery 3 is installed adjacent to the long side of the antenna 6, not to the end of the antenna 6. If the secondary battery 3 is placed near the end of the antenna 6, the interlink magnetic flux of the antenna 6 is drawn toward the outer case of the secondary battery 3 so that the interlink magnetic flux of the antenna 6 is reduced. However, since the secondary battery 3 is installed adjacent to the long side of the antenna 6, not to the end of the antenna 6, the magnetic field from the generator can be shielded without affecting the interlink magnetic flux of the antenna 6.

Further, in the case of installing the secondary battery 3 adjacent to the long side of the antenna 6, it is preferable to install the secondary battery 3 near the middle portion of the antenna 6. The installation of the secondary battery 3 near the middle portion of the antenna 6 can further reduce the impact on the interlink magnetic flux of the antenna 6. For example, the impact from the secondary battery 3 on the interlink magnetic flux of the antenna 6 can be more reduced as shown in FIG. 1 in which the secondary battery 3 is installed near the middle portion of the antenna 6, than the case of FIG. 5.

Fifth Embodiment

Figure 8:
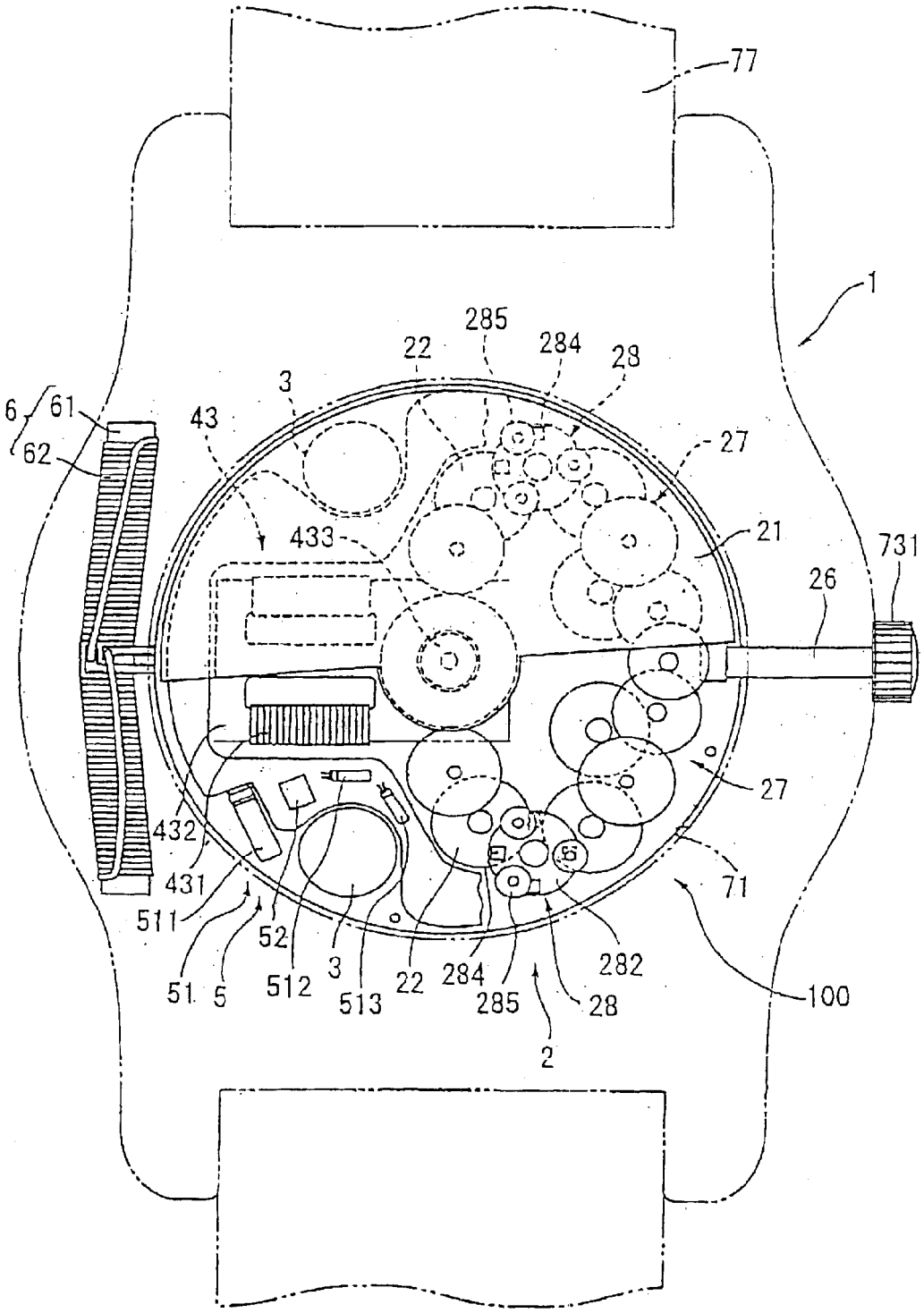
FIG. 8 is a view illustrating the internal structure with a back lid removed off according to a fifth embodiment of the present invention.

FIG. 8 illustrates a radio wave clock 1 according to the electronic timepiece of a fifth embodiment of the present invention. The radio wave clock 1 is the same as that of above each embodiment in that an antenna 6 is placed outside the diameter of the rotation path of a rotary weight 21, but the specific structure of a power-generation mechanism 2 and a driving portion 4 is different to those of the above embodiments.

The power-generation mechanism 2 includes two generators 28, the rotary weight 21 for driving the generators 28, two power transmission parts 22 for transmitting the power of the rotary weight 21 to each generator 28, a winding stem 26 of a crown 731 installed to be operated from the outside to rotate, and two wheel trains 27 for transmitting the rotation of the winding stem 26 to each generator 28.

Figure 9:
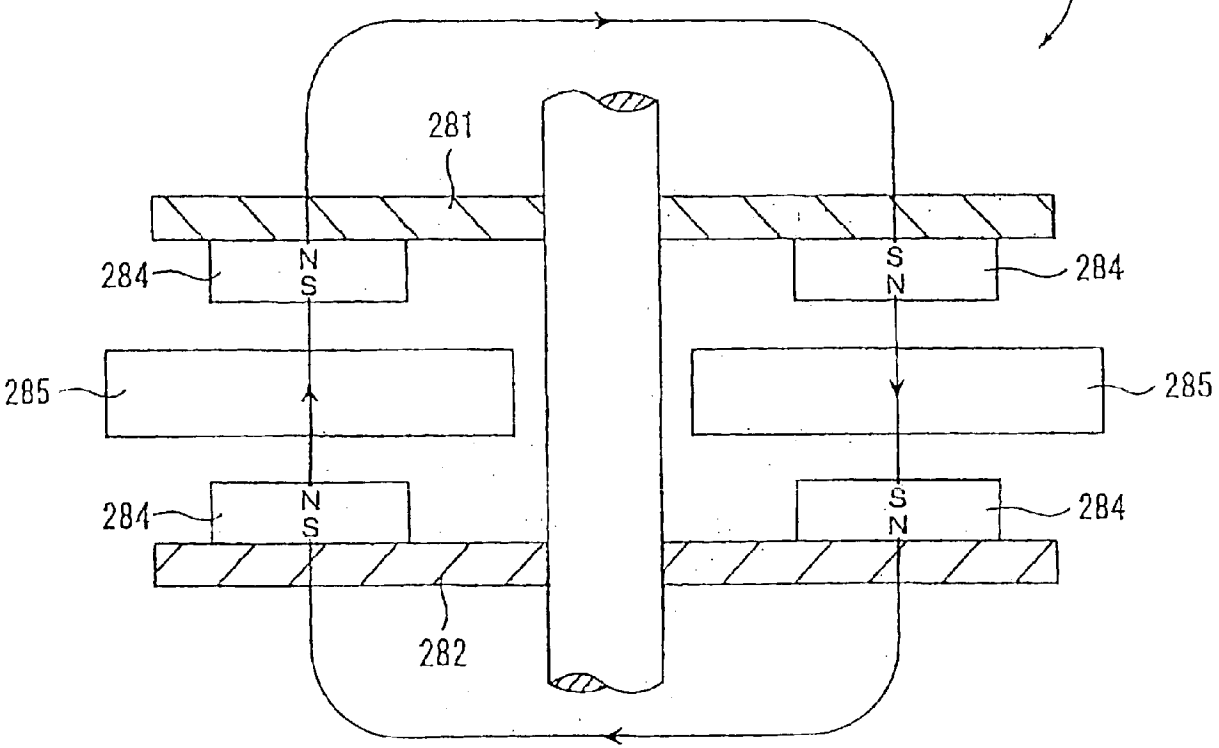
FIG. 9 is a cross-sectional view of a generator according to the fifth embodiment.

The generator 28 is rotated by the rotation (mechanical energy) transmitted through the power transmission part 22 or the wheel train 27 as shown in the cross-sectional view of FIG. 9, and includes a pair of rotor circular plates 281, 282 which are coaxially installed with a predetermined distance therebetween, magnets 284 installed to face with each other on the four locations of the rotor circular plates 281, 282 at an angle of 90° relative thereto, and three coils 285 installed between the two rotor circular plates 281, 282.

The directions of the rotation axis of the rotor circular plates 281, 282 and the central axis of the coils 285 are perpendicular to the drawing sheet of FIG. 8. That is, the axial direction of the coils 285 is substantially perpendicular to the plane including an antenna core 61 of the antenna 6.

The driving portion 4 is composed of multipolar motor 43. The multipolar motor 43 includes a coil for multipolar motor 431, a stator for multipolar motor 432 for transmitting the magnetic field from the coil for multipolar motors 431, and a rotor for multipolar motor 433 installed ratably in a stator hole of the stator for multipolar motor 432. A multiple polar magnet is provided on the peripheral part of the rotor for multiple polar motors 433. A plurality of teeth are formed on the stator for multippolar motor 432 toward the rotor for multipolar motor 433. Clock hands for displaying time are installed on the rotation axis of the rotor for multipolar motor 433.

In such a structure, if the rotary weight 21 is rotated, or the winding stem 26 is manually operated to rotate, the power is transmitted by the power transmission part 22 or the wheel train 27, and the rotor circular plates 281, 282 of the generator 28 are rotated. When the magnet 284 is rotated along with the rotation of the rotor circular plates 281, 282, the density of the magnetic flux penetrating the coil 285 is changed, and current is generated on the coil 285.

If pulses for driving clock hands are output from the coil for multipolar motor 431, a magnetic field is generated. The magnetic field affects the rotor for multipolar motor 433 through the stator for multipolar motor 432, and the rotor for multipolar motor 433 is step-rotated so that clock hands are step-driven.

According to the fifth embodiment described as above, the effects can be achieved as follows in addition to the effects (1), (3), (4), and (5) of the above embodiments.

(11) Since the coil 285 of the generator 28 is substantially perpendicular to the surface including the antenna core 61 of the antenna 6, the antenna 6 is perpendicular to the magnetic flux of the magnetic field generated from the power-generation coil 285 of the generator 28. Therefore, since the antenna 6 does not follow the magnetic flux of the magnetic field from the power-generation coil 285 of the generator 28, it is difficult for the magnetic field from the power-generation coil 285 of the generator 28 to interfere with the antenna 6, and the impact of the magnetic field from the power-generation coil 285 on the antenna 6 can be reduced so that the receiving sensitivity of the antenna 6 can be improved.

(12) Since it is difficult that the magnetic flux of the magnetic field generated from the power-generation coil 285 of the generator 28 interferes with the antenna 6, the magnetro-striction effects on the antenna 6 can be suppressed. Therefore, a similar effect to the effect (5) of the first embodiment can be achieved. That is, the progression of the internal destruction of the antenna 6 by the magnetro-striction can be suppressed, and also, the electrical insulating state between the antenna coil 62 and the antenna core 61 can last long.

Sixth Embodiment

Figure 10:
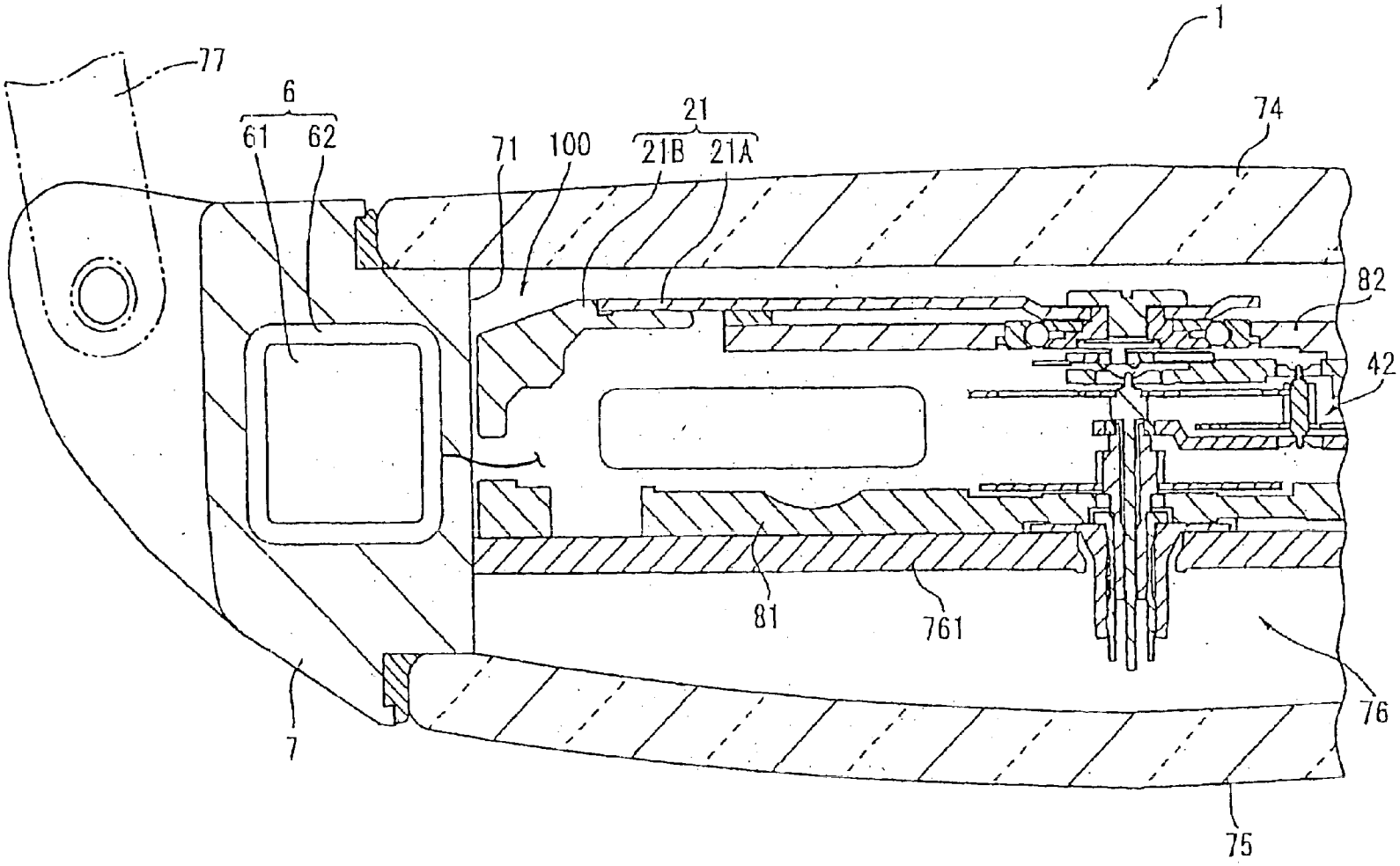
FIG. 10 is a cross-sectional view illustrating main parts of a sixth embodiment of the present invention.

FIG. 10 illustrates a radio wave clock 1 according to the electronic timepiece of a sixth embodiment of the present invention. FIG. 10 is a partial cross-sectional view of the configuration of the sixth embodiment.

The basic structure of the radio wave clock 1 is the same as that of the first embodiment, but the sixth embodiment is different from the first embodiment in the aspect as follows.

The radio wave clock 1 according to the sixth embodiment includes a body case 7, a movement for clock 100 installed inside the body case 7, and an antenna 6 for receiving standard radio waves including time information as wireless information.

The body case 7 is substantially ring-shaped, and is made from synthetic resin as a non-magnetic substance. On one face side of the body case 7, there are provided clock face 761 installed inside the ring of the body case 7, and windshield glass 75 installed in the body case 7 outside the letter plate 761. Further, there is provided a-back lid 74 on the other face side of the body case 7.

And, the clock face 761 is made from a non-conductive material such as synthetic resin and ceramic, or a diamagnetic material such as brass, and the back lid 74 is made from a non-conductive glass.

The antenna 6 is installed inside the body case 7 in the same way as in the first embodiment, but the antenna 6 is buried in the body case 7 of synthetic resin and the peripheral surface of the antenna is all coated. For burying the antenna in the body case 7, for example, the body case 7 is molded by an injection molding with the antenna 6 being placed in a predetermined position therein. Polycarbonate, ABS (acrylonitrile-butadiene-styrene resin), etc., are used for the synthetic resin.

By the structure as above, the effects can be achieved as follows in addition to the effects (1), (3), (4), and (5) of the above embodiments.

(13) Since the body case 7 is made from a synthetic resin, it does not shield electromagnetic waves unlike a metal, etc. Since the back lid 74 is made from a non-conductive glass, it does not shield electromagnetic waves. Therefore, the receiving sensitivity of the antenna 6 can be improved.

(14) Since the back lid 74 is made from a non-conductive glass, it does not shield the electro-magnetic field penetrating through the antenna 6, and it can be also made to have a see-through structure to make the inside visable so as to improve the appearance.

(15) Since the antenna 6 is buried in the body case 7 made from synthetic resin, the strength of the body case 7 can be increased by the rigidity of the antenna core 61. Further, by burying the antenna 6 inside the synthetic resin, the metal such as the coil or core of the antenna 6 is protected from corrosion or the like so that the corrosion resistance of the antenna 6 is improved, and the electrically insulating property can be much more improved. Further, it is prevented that metal powder generated from wear-out of accelerating wheel train of the power-generation mechanism or the like attaches to the peripheral surface of the antenna 6 little by little when the antenna 6 is used for long so as to gradually decrease the receiving sensitivity. That is, since the distance between the antenna 6 and brashion powder of metal is maintained constant as well as the distance between the antenna 6 and the rotary weight 21, good receiving sensitivity can be guaranteed for long.

Seventh Embodiment

Figure 11:
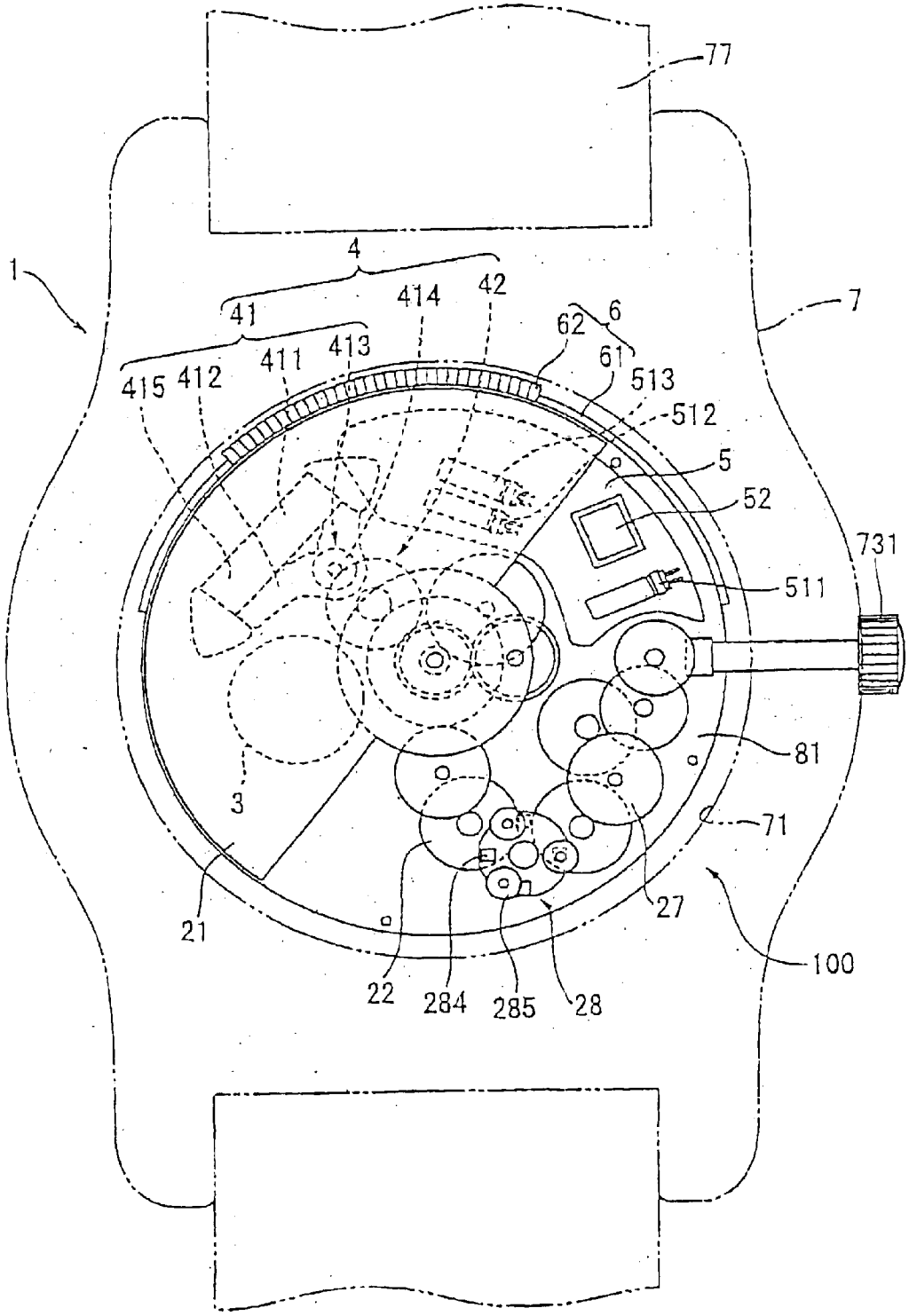
FIG. 11 is a view illustrating the internal structure with a back lid removed off according to a seventh embodiment of the present invention.
Figure 12:
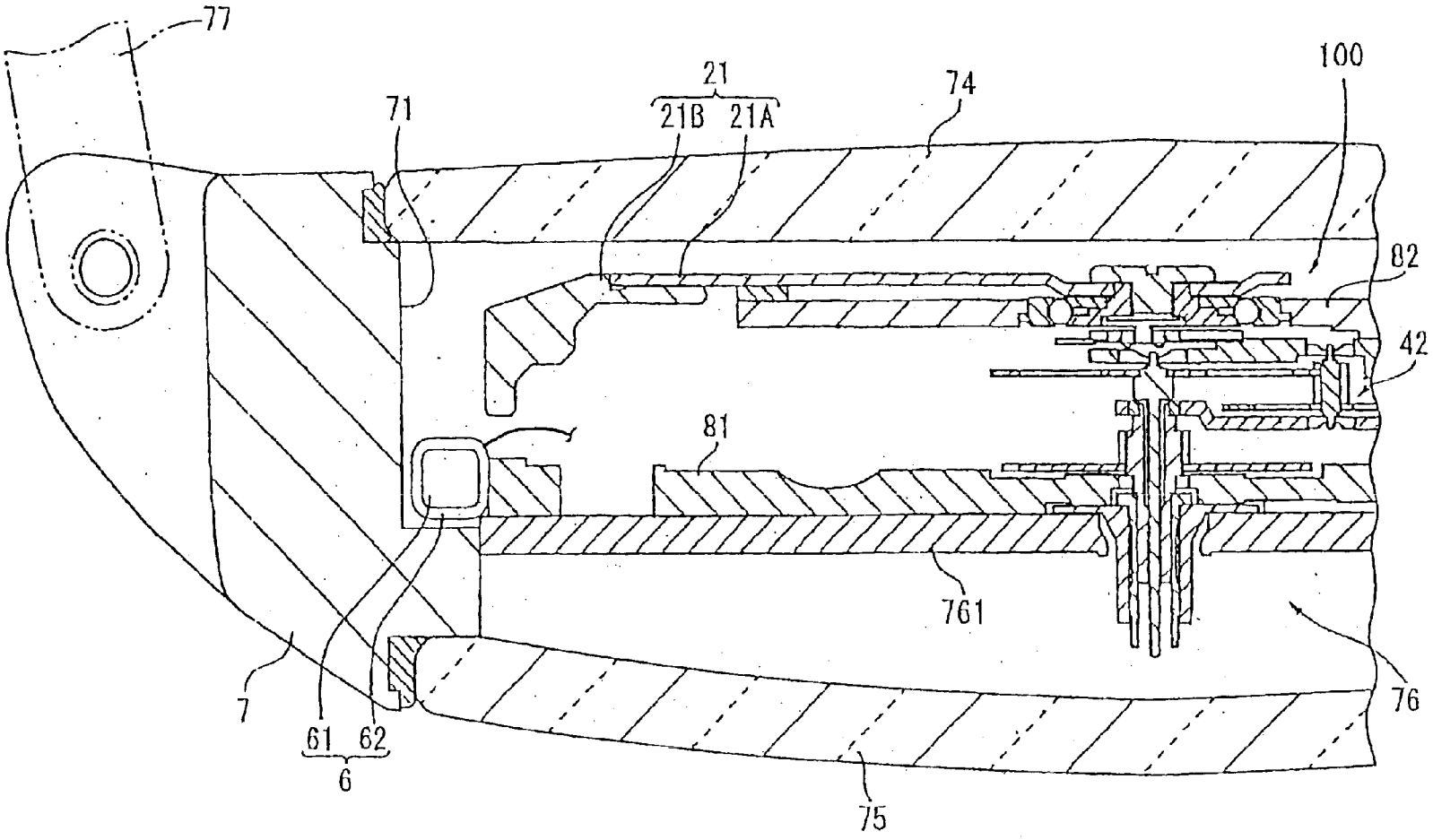
FIG. 12 is a cross-sectional view illustrating main parts according to the seventh embodiment.
Figure 13:
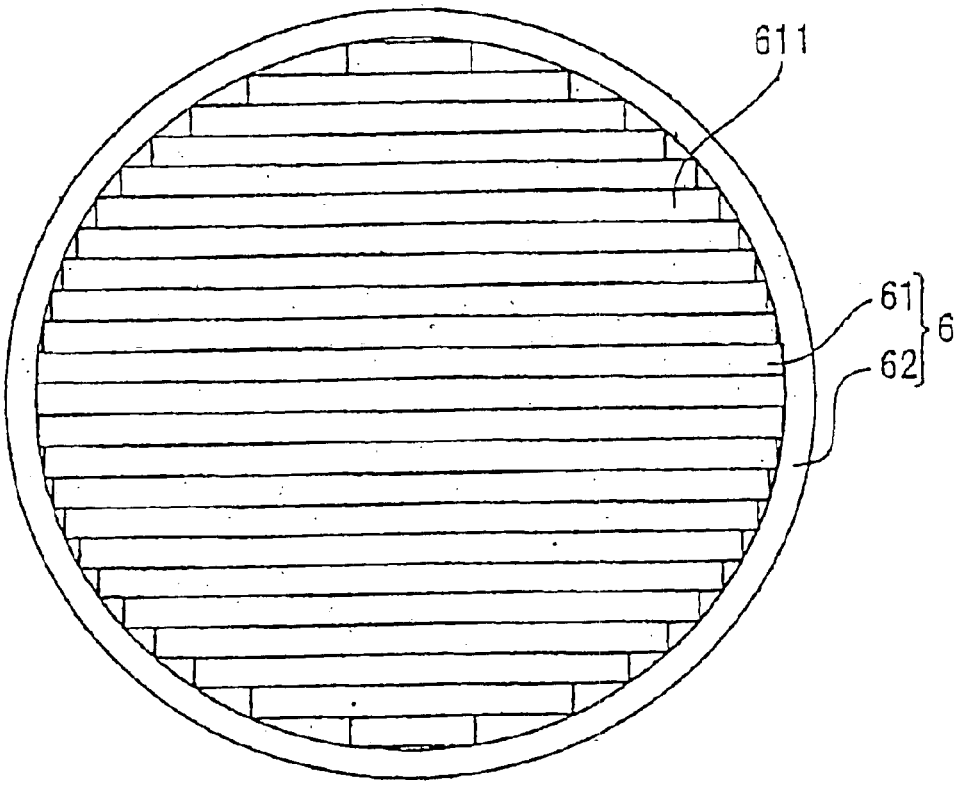
FIG. 13 is a cross-sectional view of an antenna according to the seventh embodiment.

Now, the configuration according to a seventh embodiment of the present invention is explained in reference to FIGS. 11, 12, 13. FIG. 11 is a plane view of the seventh embodiment, FIG. 12 is a partial cross-sectional view of main parts of the seventh embodiment, and FIG. 13 is a cross-sectional view of an antenna 6.

The basic structure of the seventh embodiment is the same as that of the above embodiment, but the shape and placement of the antenna 6 are characteristic.

The antenna 6 includes antenna core 61 and aft-antenna coil 62 wound around the antenna core 61. As shown in FIG. 13, the antenna core 61 is configured by laminating a plurality of thin amorphous metal plates 611, each plate being elongate and about 0.01 mm to 0.05 mm thick. The amorphous metal plate 611 is made from, for example, an amorphous metal containing 50 wt % or more of Co. Here, if the thickness of the amorphous metal plate 611 is thicker than 0.05 mm, it is difficult to rapidly cool the center—portion in thickness of the plate, and the metal is crystallized without turned into amorphous shapes. That is, to fabricate an amorphous metal, it is necessary to perform a rapid cooling process before a metal is recrystallized, and it is necessary to make the thickness of the metal small. On the other hand, if the thickness of the amorphous metal plate 611 is less than 0.01 mm, the amorphous metal plate 611 is not strong enough to endure assembling or other processes, and becomes vulnerable to deformation so that positioning or handling process of parts becomes difficult.

The thickness of the amorphous metal plates 611 is almost the same, but the width of the amorphous metal plates 611 stacked upper and lower in the thickness direction becomes gradually narrower than the amorphous metal plates 611 stacked on the middle. The amorphous metal plates 611 are bonded each other by an insulating adhesive such as epoxy resin. And, the cross-sectional shape of the stacked antenna core 61 is almost elliptic. Further, the length of the antenna core 61 is almost half of the circumferential length of the base plate 81.

As shown in FIGS. 11 and 12, the antenna core 61 is curved to fit the peripheral part of the base plate 81, and is installed on the end section of the peripheral part of the base plate 81. In FIG. 11, assuming that upside of the sheet is a 6 o'clock direction, and downside of the sheet is a 12 o'clock direction, the antenna core 61 is installed on the peripheral part of the base plate 81 within the ranges of about 3 o'clock to about 9 o'clock.

The antenna coil 62 is wound around the almost middle portion of the antenna core 61 with a predetermined width. With the antenna 6 installed on the peripheral part of the base plate 81, the antenna coil 62 is installed corresponding to the range from about 5 o'clock to about 7 o'clock.

A power-generation system 2 includes a generator 28, a rotary weight 21 for driving the generator 28, a power transmission part 22 for transmitting the power of the rotary weight 21 to the generator 28, a winding stem 26 of a crown installed to be operated from the outside to rotate, and a wheel train 27 for transmitting the rotation of the winding stem 26 to the generator 28.

Here, the structure of the generator 28 is the same as in the fifth embodiment. Further, the rotation radius of the rotary weight 21 is almost the same as the radius of the base plate 81, and the antenna 6 is placed outside of the rotation path of the rotary weight 21 in the radial direction.

The winding stem 26 of the crown 731 is installed in the direction of about 3 o'clock, and is composed of a metal member of ferromagnetic material.

A circuit block 5, a driving part 4, and a secondary battery 3 are placed on the base plate 81 besides the generator 28.

On the circuit block 5, there are installed a crystal oscillator 511 for measuring time for oscillating a reference clock, crystal oscillators 512, 513 for tuning for generating tuning signals tuned to the frequency of the standard radio waves, and an IC 52 for control for measuring a current time, and performing time correcting based on the received time information. The crystal oscillators for tuning are a crystal oscillator 513 for tuning with the standard radio waves of 60 kHz, and a crystal oscillator 512 for tuning with the standard radio waves of 40 kHz, for example, in Japan. Further, crystal oscillators for 60 kHz of standard radio waves and 77.5 kHz of standard radio waves are used, for example in Europe and America. The IC 52 for control is installed between the crystal oscillator 511 for measuring time and the crystal oscillators 512, 513 for tuning, and the crystal oscillator 511 for measuring time and the IC 52 for control are closely installed, while the crystal oscillators 512, 513 for tuning and the IC 52 for control are closely installed.

The driving part 4 and the secondary battery 3 are the same as described in the first embodiment.

A motor 41 for driving hands constituting the driving part 4 is installed within the range of about 6 o'clock to about 9 o'clock, corresponding to the range where the antenna core 61 is installed.

The body case 7 is composed of a non-conductive member such as plastic, etc. Further, the diameter of a concave portion 71, as shown in FIGS. 11 and 12, is entirely large enough to accommodate the antenna 6 therein. Alternatively, there may be provided a concave portion to open toward almost the center of the clock on the only portion corresponding to the antenna coil 62 of the antenna 6 without enlarging the diameter of the concave portion 71 on the whole.

A back lid 74 is made from a non-conductive glass, and a clock face 761 is composed of a non-conductive member.

According to the seventh embodiment structured as above, the effects can be achieved as follows in addition to the effects (1), (3), (4), (5), (6), (11), and (12) in the above embodiments.

(16) The antenna 6 is shaped to fit along the peripheral part of the base plate 81, and is installed on one end surface of the peripheral part of the base plate 81. As a result, the base plate 81 and the antenna 6 are integrated, and the antenna 6 does not protrude from the movement 100. Further, since a space is not necessary in the body case 7 to receive the antenna 6, the body case 7 can be made small in its appearance by making its body of the body case 7 thin. As a result, the radio wave clock 1 can be miniaturized as a whole, and the shape of the base plate can be selected freely so as to improve the design of the clock.

(17) Since the antenna core 61 is formed by stacking the plurality of thin amorphous metal plates 611, the antenna core 61 can be easily bent and the antenna 6 can be curved along the peripheral part of the movement 100. Further, since each of the amorphous metal plates 611 is thin, and insulated from each other by epoxy resin, eddy current generated from each amorphous metal plate 611 can be reduced. Then, the magnetic field generated from the eddy current can be suppressed, and as a result, the receiving sensitivity of the antenna 6 can be improved.

(18) The winding stem 26 is placed in the direction of about 3 o'clock, and the end of the antenna core 61 is placed near about 3 o'clock. Then, since the electromagnetic wave induced by the winding stem 26 is easily interlinked by the antenna core 61, the interlink magnetic flux of the antenna 6 can be increased, and the receiving sensitivity of the antenna 6 can be improved.

(19) The crystal oscillator 511 for measuring time is closely installed to the control IC 52, and the crystal oscillators 512, 513 for tuning are closely installed to the control IC 52. Therefore, stray capacitance from the wiring of connecting the crystal oscillators 511~513 and the control IC 52 can be reduced. As a result, the time-measuring error can be reduced, and since the wiring length becomes shorter, the impedance is reduced, and the energy for transmitting signal can be reduced.

(20) Since a rotor 413 of the motor 41 for driving hands is rotated floating from a stator 412, there occurs a case that an error happens in rotation period by the external magnetic field from the outside, but by arranging the antenna coil 62 outside the motor 41 for driving hands, the external magnetic field penetrating from the outside of the clock body can be shielded by the antenna coil 62. Therefore, the rotation of the rotor of the motor 41 for driving hands can be precisely controlled, and even a motor having a small antimagnetic performance can be employed.

Figure 14A:
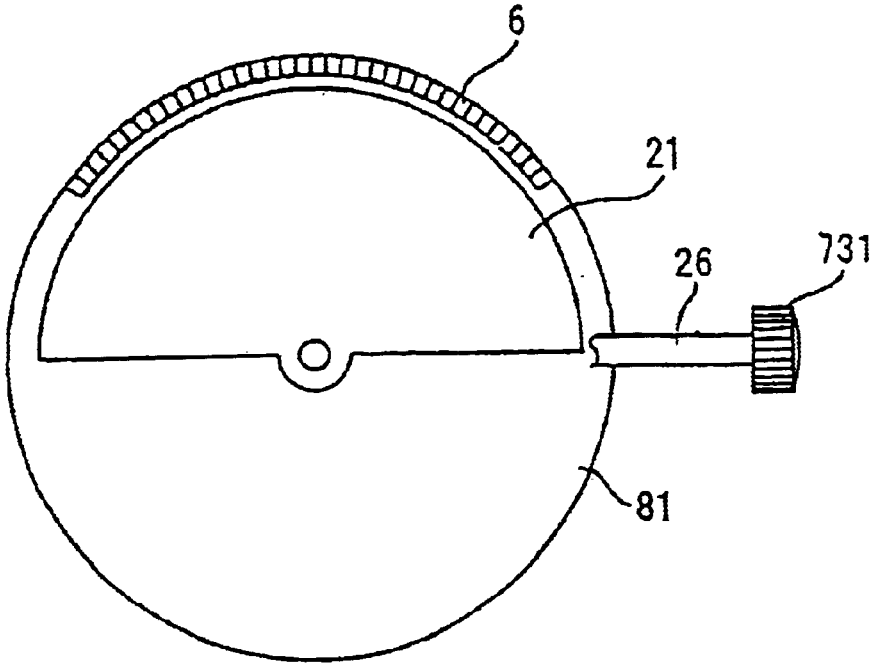
FIG. 14(A) is a view illustrating an example of the modification of the placement location of the antenna.

Here, in the case of placing the antenna 6 along the peripheral part of the base plate 81, as shown in FIG. 14(A), the antenna 6 can be installed along the outermost circumference edge on the base plate 81. By the structure as above, the effects can be achieved as follows.

(21) Since the antenna 6 is received inside the movement 100, the clock can be much more miniaturized. Further, by forming a concave portion the base plate 81 at the position corresponding to the antenna coil 62, even if the winding of the antenna coil 62 becomes bigger in diameter, the antenna 6 can be configured not to be obstructed by the base plate 81.

Figure 14B:
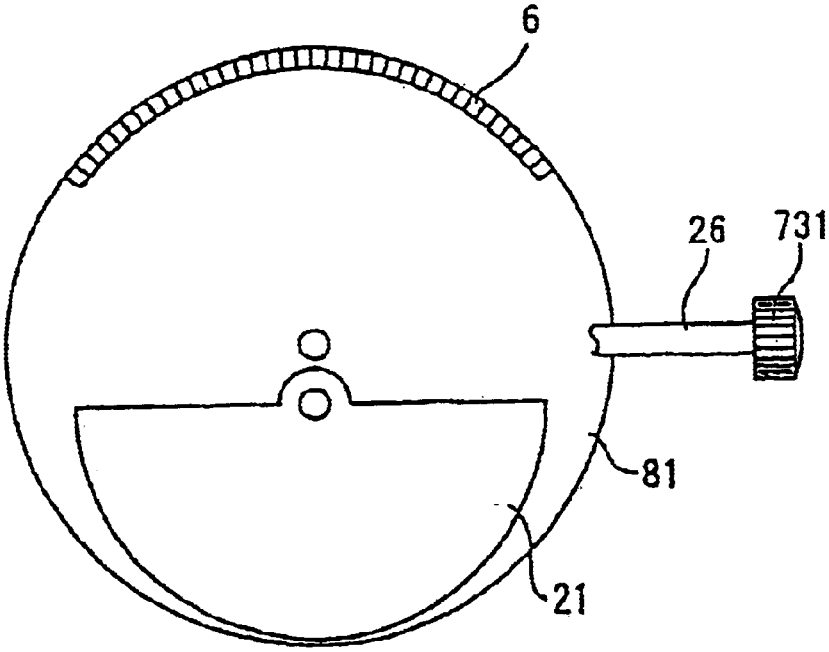
FIG. 14(B) is a view illustrating an example of the modification of the placement location of the antenna, and the location of the center O of rotation of the rotary weight.

Or, in the case of placing the antenna 6 along the peripheral part of the base plate 81, as shown in FIG. 14(B), the center of the movement 100 is possibly made eccentric from the center of the rotary weight 21. That is, the rotation axis of the rotary weight 21 may be eccentrically arranged from the center of the movement 100 to one side. In FIG. 14(B), it is off-center to the lower side of the drawing sheet, that is, toward 6 o'clock direction. Further, the antenna 6 is placed along the outermost circumference of the surface of the base plate 81, within the range of about 3 o'clock to about 9 o'clock with the about 12 o'clock direction being the center thereof.

By the above structure, the effects can be achieved as follows.

(22) Since the movement 100 and the rotary weight 21 are moved eccentrically, torque functioning on the rotary weight 21 from the movement on the clock body by the external impact is increased, and the power sensitivity is improved.

(23) The antenna 6 is placed in the direction of about 12 o'clock whereas the rotary weight 21 is eccentrically placed closer to the 6 o'clock position. Therefore, since the distance between the rotary weight 21 and the antenna 6 becomes longer, the electromagnetic waves easily reach the antenna 6 without being shielded by the rotary weight 21. As a result, the receiving sensitivity of the antenna 6 can be improved.

(24) Since the hand axis of the clock placed on the center of the movement 100 and the rotation axis of the rotary weight 21 do not overlap, the thickness of the clock can be made thin.

Eighth Embodiment

Figure 15A:
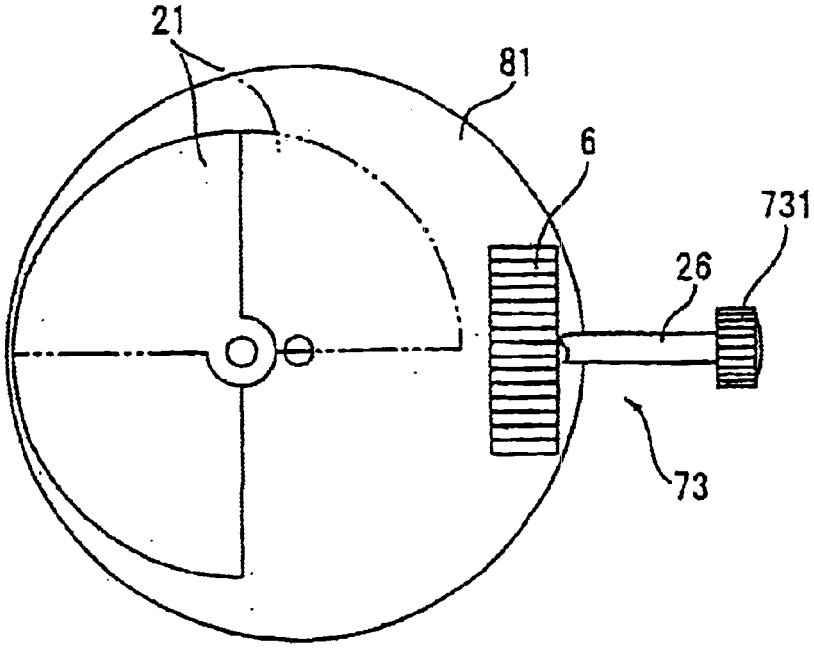
FIG. 15(A) is a plane view of the main parts according to an eighth embodiment of the present invention.
Figure 15B:
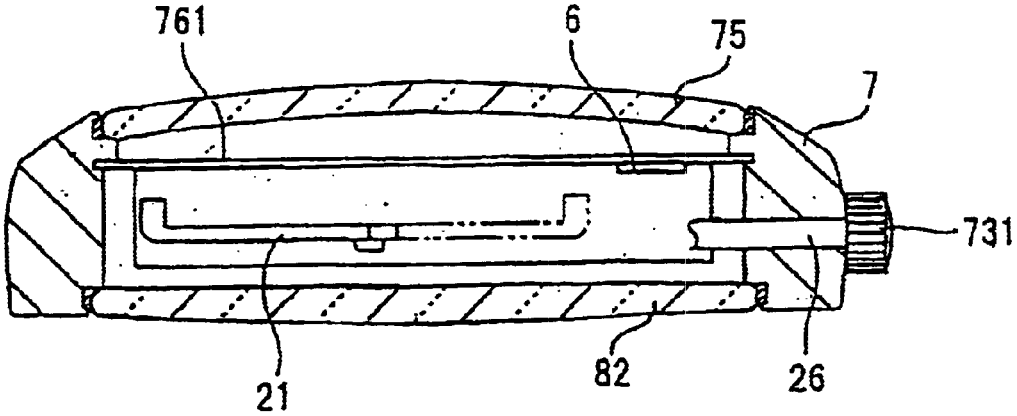
FIG. 15(B) is a cross-sectional view of the main parts according to the eighth embodiment.

Now, the configuration of an electronic timepiece according to an eighth embodiment of the present invention is explained in reference to FIG. 15. FIG. 15(A) is a plane view of the main parts of the eighth embodiment, and FIG. 15(B) is a partial cross-sectional view of the main parts of the eighth embodiment.

The basic configuration of the eighth embodiment is the same as the above embodiments, but the shape and placement of the antenna 6, and the placement of the rotation axis of the rotary weight 21 are characteristic.

In FIG. 15(A), the eight embodiment includes a base plate 81 forming a movement 100, an antenna 6, a rotary weight 21 forming a power-generation system 2, and a winding stem 26 forming an external manipulation mechanism 73.

The antenna 6 is a flat-typed antenna 6 formed by winding an antenna coil 62 around a flat rectangular-shaped antenna core 61. The antenna 6 is disposed in the direction of about 3 o'clock on the base plate 81, with its long side in parallel to the direction of 6 o'clock to 12 o'clock.

The rotary weight 21 is eccentrically installed in the direction of about 9 o'clock from the center of the movement 100. As shown in FIG. 15(B), while the rotary weight 21 is placed to the back lid 74 made from glass, the flat-typed antenna 6 formed on the base plate 81 is placed to the letter plate 761.

The winding stem 26 is installed in the direction of about 3 o'clock, and moves across above the flat-typed antenna 6 in the short direction.

Further, the eccentric direction of the rotation axis of the rotary weight 21 or position of the flat-typed antenna 6 is not specifically limited, but can be selected variously according to the arrangement of the other parts.

According to the configuration of the eighth embodiment as above, the effects can be achieved as follows in addition to the (1), (4), (14) effects of the above embodiments.

(25) Since the flat-typed antenna 6 is thin shaped, it can be placed to overlap with the winding stem 26 two-dimensionally, and both of them can be placed to the same side. In the case that a wearer takes off the clock and puts it on a table, etc., it is typically placed such that the winding stem 26 is directed upward the upside (not toward the table surface). Then, since the rotary weight 21 is moved lower side, that is the direction of 9 o'clock, the antenna 6 in the direction of 3 o'clock and the rotary weight 21 are furthest away from each other. Therefore, the receiving sensitivity of the clock can be improved with the clock placed on the table. Particularly, by setting the time of the radio wave reception to be midnight, the possibility increases that radio waves can be received by the clock placed as above. As a result, standard radio waves can be exactly received by the antenna 6.

(26) While the flat-typed antenna 6 is placed on the base plate, the rotary weight 21 is placed to the back lid 74. Therefore, the flat-typed antenna 6 and the rotary weight 21 can be separated in the direction of the rotation axis of the rotary weight 21. Then, even the electromagnetic waves progressing across the rotation axis of the rotary weight 21 can be received by the antenna 6 without being shielded by the rotary weight 21 so that the receiving sensitivity of the antenna 6 can be improved.

(27) Since the rotation axis of the rotary weight 21 and the center of the movement 100 are eccentric to each other, there exists a space outside the rotation path of the rotary weight 21 on the surface of the base plate 81. Therefore, the flat-typed antenna 6 can be placed on the base plate 81 outside the rotation path of the rotary weight 21. Therefore, the antenna 6 can be only placed on the base plate 81 when assembling so that the assembling is simplified, and the fabrication efficiency can be improved.

Ninth Embodiment

Figure 16:
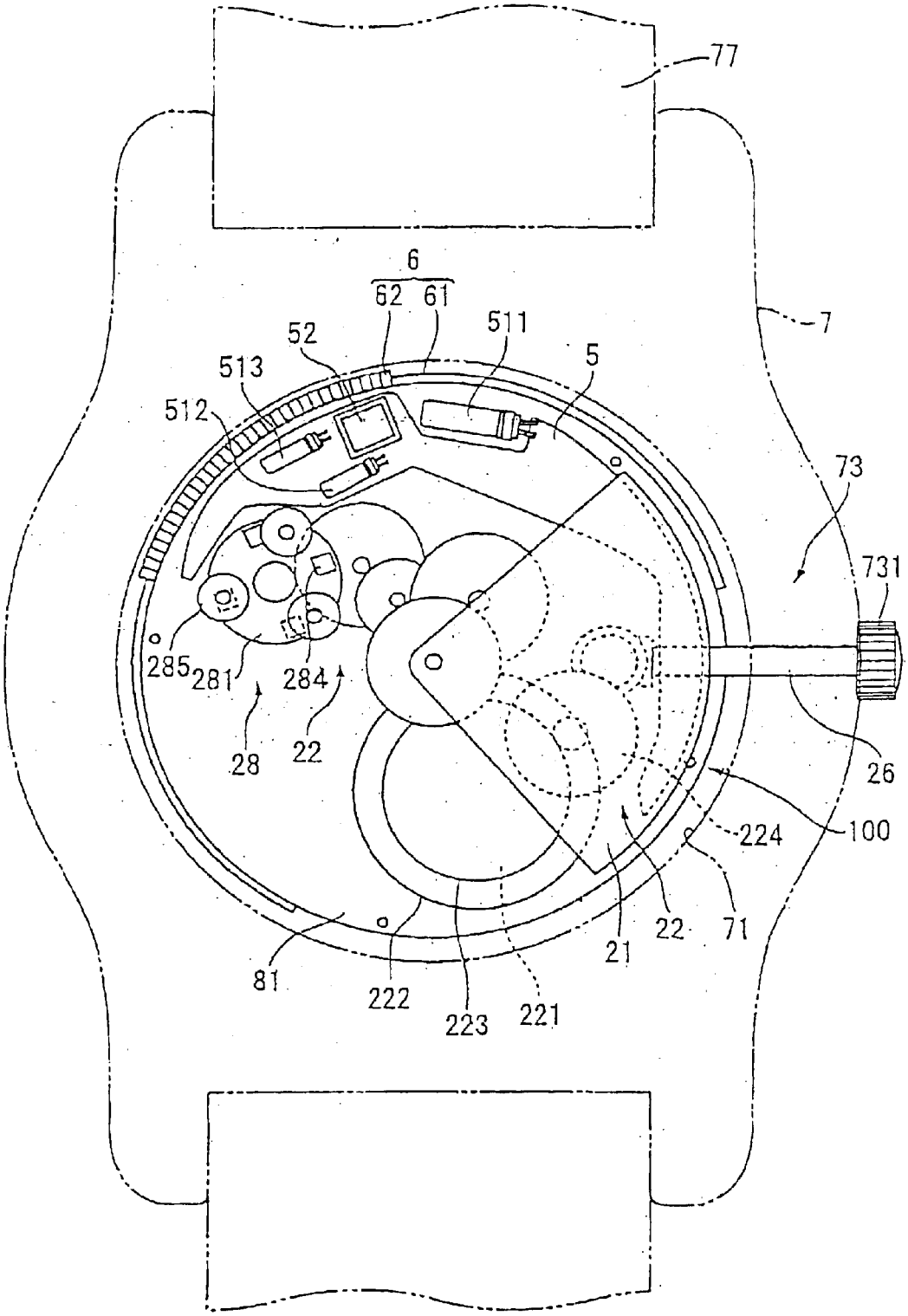
FIG. 16 is a view illustrating the internal structure with a back lid removed off according to a ninth embodiment of the present invention.
Figure 17:
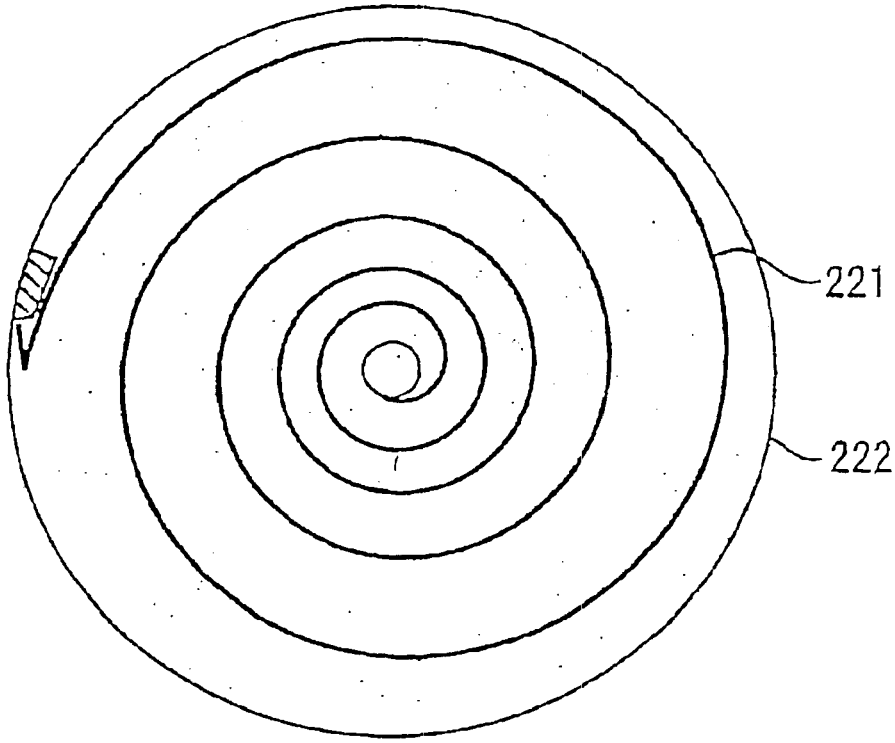
FIG. 17 is a view of a main spring according to the ninth embodiment of the present invention.
Figure 18:
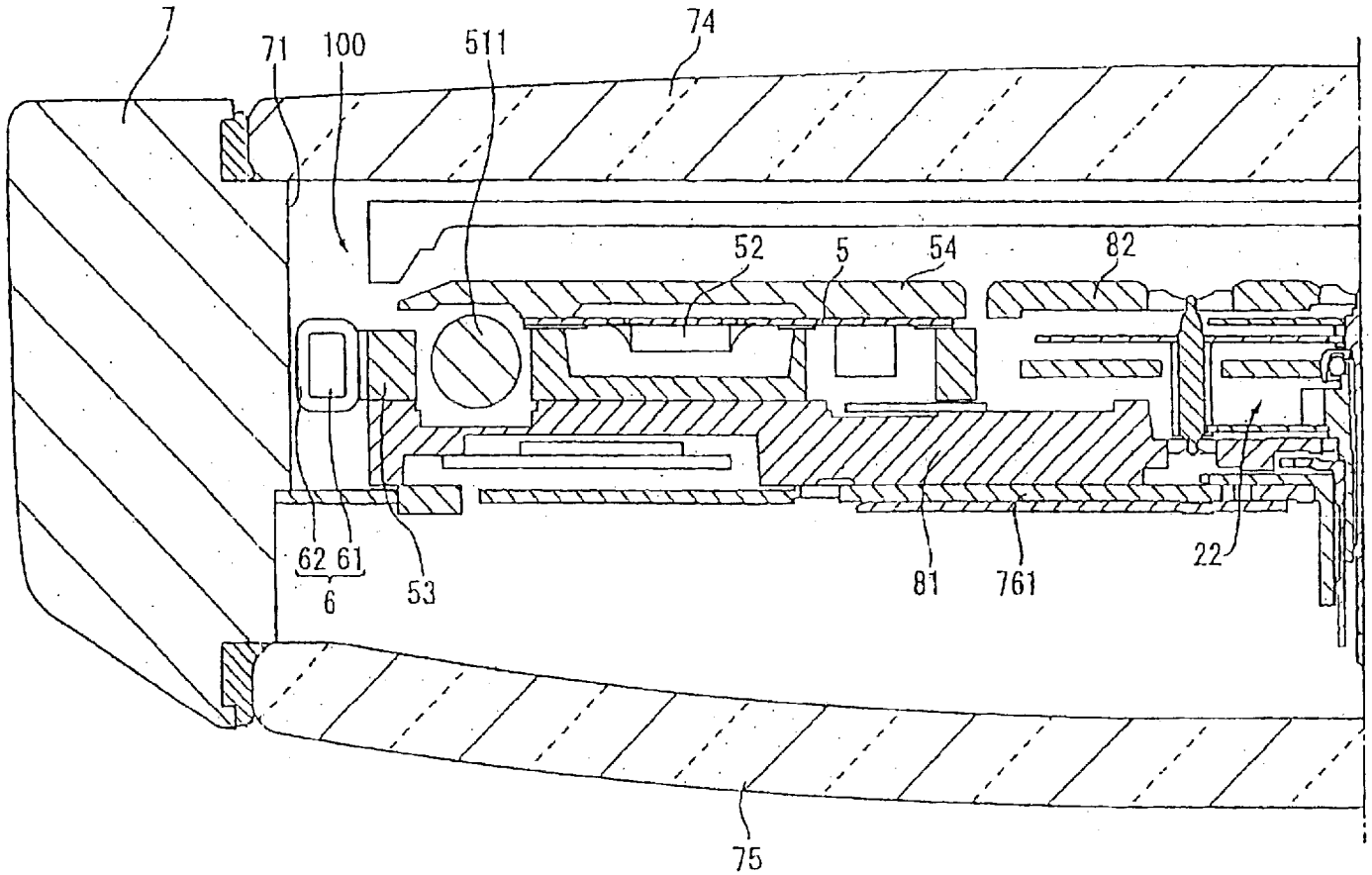
FIG. 18 is a cross-sectional view of the main parts according to the ninth embodiment.

Now, there is explained an electronic timepiece according to a ninth embodiment of the present invention in reference to FIGS. 16, 17, 18. FIG. 16 is a plane view of a movement 100 of the ninth embodiment viewed from a back lid 74 side, FIG. 17 illustrates a main spring 221, and FIG. 18 is a partial cross-sectional view of the ninth embodiment. In FIG. 16, it is assumed that the upper part of the drawing sheet is the 12 o'clock direction, and the right part of the drawing sheet is the 3 o'clock direction.

The clock of the ninth embodiment comprises a body case 7, the movement for clock 100, an antenna 6, a letter plate 761, a windshield 75, and the back lid 74 are the same as in the above embodiment.

As shown in FIG. 16, the movement for clock 100 includes a base plate 81, a wheel train bridge 82, a rotary weight 21 having the almost center of the base plate 81 as its rotation center, a winding stem 26 as an external manipulation mechanism 73, a main spring 221 as a storing device of the mechanical energy generated by the rotary weight 21 and the winding stem 26, a generator 28 to generate electricity by the power of the main spring 221, a power transmission part 22 as an energy transmission mechanism for connecting the main spring 221 and the generator 28, and a circuit block 5.

The base plate 81 is almost circular plate-shaped, and is composed of a non-conductive member (for example, synthetic resin) or a diamagnetic material (for example, brass).

There is installed the rotary weight 21 having the almost center of the base plate 81 as its rotation axis. The rotary weight 21 has a central angle of about 90°, and is installed to be rotatable at 360° or more. The rotary weight 21 is made from a conductive material such as gold, gold alloy, or a heavy metal such as tungsten alloy.

On the base plate 81, there is installed the main spring 221 as a power storage mechanism of the mechanical energy generated from the rotation of the rotary weight 21. The main spring 221, as shown in FIG. 17, is received inside a barrel wheel 222, and is made from an amorphous non-magnetic material for preventing a torque change by magnetizing, etc.

The rotation axis of the rotary weight 21 is engaged with a square hole wheel 223 integrally rotating with a barrel arbor, and the square hole wheel 223 is rotated by the rotation of the rotary weight 21 so as to wind and raise the main spring 221. Further, the winding stem 26 is installed in the direction of about 3 o'clock for manually winding the main spring 221. The winding stem 26 is composed of a metal member of a ferromagnetic material. The rotation of the winding stem 26 is transmitted to the square hole wheel 223 by the wheel train having a transmission wheel 224, and the main spring 221 is wound by the rotation of the winding stem 26.

The main spring 221 is located within the range from about 11 o'clock to about 2 o'clock. The rotation of the barrel wheel 222 is transmitted to the generator 28 by the power transmission part 22. The basic structure of the generator 28 is similar to the generator 28 described in the fifth embodiment. Further, the axes of the clock hands (not shown) are engaged with each other in the middle of the power transmission part 22 so that the clock hands are rotated by the force from the unwinding of the main spring 221. The generator 28 is located within the range from about 7 o'clock to about 8 o'clock.

Almost crescent-shaped circuit block 5 is installed on the base plate 81. A wiring pattern is installed on the surface of the circuit block 5 facing the base plate 81. On the circuit block 5 there are installed a crystal oscillator 511 for measuring time for oscillating a reference clock, crystal oscillators for tuning signals 512, 513 for generating signals tuned to the standard radio waves, and an IC 52 for control. One of the two crystal oscillators for tuning signals 512 is for 40 kHz and the other 513 for 60 kHz. The IC 52 for control is installed within the range from about 6 o'clock to about 7 o'clock. The crystal oscillator 511 for measuring time and the crystal oscillators 512, 513 for tuning signals are installed with the IC 52 for control between them. A power block (not shown) is installed on the circuit block 5, and the power generated by the generator 28 is stored in the power block.

The control IC 52 tracks the current time based on a reference clock generated from the oscillation of the crystal oscillator 511 for measuring time, and controls the electrical current passing through the power-generation coil 285 so as to control (rotation control) the rotation speed of rotor circular plates 281, 282, and precisely control the needling of the clock hands (not shown) connected to the wheel train 27. Further, if the time displayed by the clock hands becomes slow, an accelerating pulse is applied to the generator 28. Also, a confirmation of the displayed time is performed, for instance, such that a gear of a second wheel train to which the second hand is connected is formed to have a larger load than the other gears, and the generation voltage of the power-generation coil and the rotation speed of the second wheel train are compared with each other to confirm if the second wheel train is rotating according to a reference timing. Or, it can be confirmed by forming a through hole for passing light on one gear of the second wheel train, and checking the rotation of the second wheel train according to the timing of light passing through the through hole.

Further, the control IC 52 corrects the tracking of the current time based on the time information of standard radio waves received by the antenna 6, and corrects the location of the hands.

The circuit block 5 is composed of FPC (flexible printed circuit), and is made to be flexible, and is installed on the base plate 81 with inserted between a circuit receptacle seat 53 and a circuit bridge 54. The circuit receptacle seat 53 and the circuit bridge 54 are composed of an electrically insulating member such as ceramic or synthetic resin.

The antenna 6 is installed along the peripheral part of the movement 100. The antenna 6 is installed in the peripheral end part of the circuit receptacle seat 53. The structure of the antenna 6 is the same as described in the seventh embodiment. The antenna core 61 is installed in the peripheral end part of the circuit receptacle seat 53 within the range from about 12 o'clock to about 8 o'clock. The antenna coil 62 is wound around the antenna core 61 with the about 4 o'clock direction being the center. The antenna coil 62 and the IC 52 for control are connected by a wiring, which is not shown.

According to the ninth embodiment structured as above, the effects are achieved as follows in addition to (1), (2), (4), (11), (12), (14), (16), (17), (18) and (19) effects of the above embodiments.

(28) Since the antenna coil 62 surrounds the movement 100 within the range from about 12 o'clock to about 8 o'clock, the external magnetic field penetrating from the outside of the clock body is shielded by the antenna core 61 before coming deep into the clock body. Therefore, the external magnetic field does not affect the generator 28 and the antimagnetic performance can be improved. Since the external magnetic field does not affect the generator 28, the rotation control by the generator 28 can be performed precisely, the precise needling of the clock hands can be performed.

(29) Since the antenna 6 is installed in the peripheral end part of the circuit receptacle seat 53, the wiring distance of the circuit block 5 supported by the circuit receptacle seat 53 and the antenna 6 can be shortened, and the control IC 52 and the antenna 6 can be placed closely.

(30) The axial line of the power-generation coil 285 of the generator 28 is substantially perpendicular to the base plate 81, that is, almost perpendicular to the axial line of the antenna 6. Therefore, since the direction of the magnetic field from the generator 28 and the direction of the magnetic field of the antenna 6 are almost perpendicular to each other, they are in the placement in which it is difficult to interfere with each other. Further, as shown in FIG. 9, since the magnetic field generated in the generator 28 makes a closed loop by the power-generation coil 285 of the generator 28 and a magnet 284, the magnetic field is hardly leaked out. Therefore, since the antenna 6 and the generator 28 are difficult to interfere with each other magnetically (the reduction of mutual inductance), the antenna 6 and the generator 28 can be placed closely each other.

It should be understood that the electronic timepiece and the electronic apparatus of the present invention are not limited to the configurations of the embodiments described as above, but various modifications can be possible within the range of the spirit of the present invention.

For example, the rotary weight 21 may be one which vibrates at an angle less than 360° instead of over 360°.

In the first embodiment, it is possible to make the crossing angle of the central axis 6A of the antenna 6 and the central axis 25A of the power-generation coil 25 60° to 120°, instead of about 90°. In such a structure, since the magnetic flux of the magnetic field from the power-generation coil 25 does not follow the antenna 6, it is difficult for the magnetic field to affect the antenna 6.

In each embodiment, the number of the motor 41 for driving hands or the secondary battery 3 is not specifically limited, and may be one or two or more.

In each embodiment, the magnetic field shielding member is not limited to the coil core 415 of the motor 41 or the case of the secondary battery 3, and for example, an additional new magnetic field shielding member can be installed.

As the magnetic field shielding member, steel, nickel, or various alloy such as permalloy and amorphous metal can be used, which means, socalled a ferromagnetic material of high magnetic permeability is acceptable.

The coil core 415 of the motor 41 for driving hands can be made from a cobalt-based amorphous metal in which cobalt is included by 50 wt % or more. The stator 412 for motor can be made from a steel-based amorphous metal in which steel is included by 50 wt % or more. Since such amorphous metals have high magnetic permeabilities, the coil core 415 or the stator 412 for motor can be used as the magnetic field shielding member. Further, in the case that the coil core 415 is made from an amorphous metal including 50 wt % or more of cobalt, the core loss can be prevented so as to improve the efficiency of the motor.

Further, in each of the embodiments as above, the magnetic field shielding means is not always required. That is, in the present invention, it is enough that the antenna 6 is installed outside the diameter of the rotation path of the rotary weight 21, and it is not restricted whether or not the magnetic field shielding means is installed between the antenna 6 and the power-generation coil 25. This is because even if the magnetic field shielding means is not installed, the impact of the magnetic field from the power-generation coil 25 can be reduced only if the distance between the antenna 6 and the power-generation coil 25 is guaranteed.

In each of the above embodiments, while wireless information is received by the antenna 6, the driving of the motor 41 for driving hands may be stopped. As above, if the flow of the current of the motor 41 for driving hands stops during the reception of wireless information, the magnetic field generated from the motor 41 for driving hands does not overlap the antenna 6, and the magnetic field from the power-generation coil 25 can be also shielded efficiently by the coil 411 for motor of the motor 41 for driving hands. Normally, since the current necessary to drive the hands is intermittent and very weak, and even if such current flows through the motor 41 for driving hands, the magnetic field generated from the coil 411 for motor is small, and it can function as the magnetic field shielding means sufficiently.

In the above embodiments, it has been explained that when the antenna 6 is placed along the peripheral part of the movement 100, the antenna 6 is attached on the base plate 81 or is placed in the circuit receptacle seat 53, but besides that, it is possible that, for example, the antenna 6 is shaped to curve along the peripheral part of the movement in order attach the antenna 6 on the body case 7 along the outer circumferential edge of the movement 100.

In FIG. 15 of the eighth embodiment, there is explained the case that the center of the movement 100 and the rotation axis of the rotary weight are different, but-it is possible that the base plate 81 is configured in an elliptic shape, and the rotation radius of the rotary weight 21 is made shorter than the long axis of the elliptic-shaped base plate 81. In such a structure, there exists an area on the base plate 81 outside the rotation radius of the rotary weight 21.

Further, in each of the above embodiments, in the case that the center of rotation of the rotary weight 21 and the hands axes of the clock hands are deviated, it is possible that the axes of the hands are deviated from the center of the movement 100, the rotation axis of the rotary weight 21 is deviated from the center of the movement 100, or the axes of the hands is deviated from the center of the movement 100 with the rotation axis of the rotary weight 21 being the center of the movement 100. Further, the rotary weight 21 can be installed between the upper part of the clock face and the glass.

In the ninth embodiment, the power storage mechanism for mechanical energy is explained as a main spring, but the power storage mechanism for mechanical energy is not limited to it, and for example, rubber or spring, etc. can be used.

Here, in each of the above embodiments, it is preferable that the antenna coil is wound in alignment. By such a structure, it looks good in the appearance, and gives precise impression. Further, by arranging vectors of the linterlink magnetic flux, the receiving sensitivity can be improved. Further, the material of the coil includes a copper line, a silver line, etc.

Further, the cross-sectional shape of the winding of the antenna coil is preferably almost a square. Then, compared with the case of a circular shaped-section of the winding, there occurs much smaller gap between coil lines when winding the coil around the antenna core. As a result, the number of turns is increased, and also, the winding lines can be wound densely without gap, and by increasing or concentrating the linterlink magnetic flux, the receiving sensitivity can be improved. Further, with the same number of turns, it is possible to miniaturized the antenna 6 itself, and the radio wave correction clock itself.

Further, in the case of a circular shaped-section of the winding of the antenna coil, when winding a coil around the antenna core, the coil may be wound to deform the sectional shape to an almost hexagon, while drawn by stress within plastic deformation thereof. Then, the winding can be done in a honeycomb shape, and there exists no dead space so as to facilitate a miniaturization. Further, since the coils can be wound densely without gap, the interlink magnetic flux can be concentrated and the receiving sensitivity can be improved.

The present invention is not limited to a radio wave clock, and can be applied to an electronic timepiece for receiving wireless information with the antenna 6 and the rotary weight 21, or electronic apparatus having no time-measuring mechanism. And, the present invention can be applied to various electronic apparatus such as a portable radio, music box, mobile phone, portable radio equipment, and electronic notebook. Particularly because of generation by using the rotary weight 21, rapid charge is possible in a short time, and it is suitable for a small-sized electronic apparatus which is carried by a user. Examples of such apparatus includes the one which receives the measurement results of physical characteristics such as atmospheric pressure, gas density, voltage, and current transmitted as wireless information, and drives their hands to analog display the measurement values.

Further, the wireless information is not limited to time information by long wave standard radio waves. For example, it is possible with the wireless information in FM or GPS, or bluetooth, or non-contact IC card, and also with wireless information of news, weather reports, and stock information.

If the received external wireless information is, for example, a weather report, it can be displayed by driving hands so as cause the hands to direct pre-prepared indications such as fine, cloddy, rain, or the news or stock information can be displayed by using a display apparatus such as a liquid crystal display device, etc.

Further, the above embodiments can be properly combined.

Industrial Applicability

According to the present invention, the electronic timepiece and the electronic apparatus of the present invention are useful as an electronic apparatus such as an electronic timepiece having a function to receive wireless information, and particularly useful as a radio wave correction clock which automatically generates by a generating means using a rotary weight, receives time information transmitted by wireless (standard radio waves), and performs time correction.

What is claimed is:

1. An electronic timepiece comprising:

a power-generation mechanism having a rotary weight made from a conductive material;

a generator for converting mechanical energy generated by rotation of the rotary weight into electrical energy;

a time-measuring mechanism for measuring time; and a receiving mechanism having an antenna for receiving wireless information;

wherein the antenna is placed outside the outer circumferential edge, in the radial direction, of the rotation path of the rotary weight.

2. The electronic timepiece according to claim 1, wherein the electronic timepiece further comprises:

a power storage mechanism for storing the energy generated by the power-generation mechanism;

a driving mechanism driven by the power stored in the power storage mechanism; and hands for time display, which are rotated by the driving force of the driving mechanism.

3. The electronic timepiece according to claim 1, wherein the wireless information is conveyed via standard radio waves and includes time information; and wherein the electronic timepiece is a radio wave correction clock that receives the standard radio waves and corrects the measured time of the time-measuring mechanism.

4. The electronic timepiece according to claim 1, wherein said timepiece further comprises a movement; and wherein the antenna has a curved shape that contours to a peripheral part of the movement, and wherein the antenna is placed along this peripheral part of the movement.

5. The electronic timepiece according to claim 1, wherein the electronic timepiece further comprises a case body composed of a non-conductive material, said case body being effective for receiving the power-generation mechanism and the time-measuring mechanism therein; and wherein at least a part of the antenna is buried in the case body.

6. The electronic timepiece according to claim 1, wherein:

said timepiece further comprises a movement; and the rotation axis of the rotary weight and the central axis of the movement are eccentrically placed with respect to each other.

7. The electronic timepiece according to claim 1, wherein the rotation path of the rotary weight defines a plane of rotation and the antenna does not intercept said plane of rotation.

8. The electronic timepiece of to claim 1, wherein said generator comprises:

a pair of rotor circular plates rotated by energy from the rotary weight, said rotor circular plates being positioned a predetermined distance opposite each other with their axial direction being substantially perpendicular to a plane that includes an antenna core of said antenna;

magnets facing each other from opposed surfaces of said rotor circular plates; and a power-generation coil placed between said rotor circular plates, with an axial line of said power-generation coil being in a direction substantially perpendicular to the plane that includes said antenna core.

9. The electronic timepiece of to claim 1, wherein said antenna is formed by layering thin plates of amorphous metal.

10. The electronic timepiece of to claim 1, further comprising a band made from a conductive material, wherein when said band is attached to the timepiece and viewed from a visual time-checking direction, said antenna and said band do not overlap each other.

11. An electronic timepiece comprising, a power-generation mechanism having a rotary weight made from a conductive material:

a generator for converting mechanical energy generated by rotation of the rotary weight into electrical energy;

a time-measuring mechanism for measuring time; and a receiving mechanism having an antenna for receiving wireless information;

wherein the antenna is placed outside the outer circumferential edge, in the radial direction, of the rotation path of the rotary weight;

wherein said generator further has a power-generation coil; and wherein the antenna and the power-generation coil are placed opposite each other with the center of rotation of the rotary weight therebetween.

12. The electronic timepiece of claim 11, wherein said generator generates a magnetic field during the converting of mechanical energy to electrical energy, and said electronic timepiece further comprises:

a magnetic field shield for shielding said antenna from said magnetic field.

13. The electronic timepiece of claim 12, wherein:

said generator includes a power-generating coil and said magnetic field emanates from said power-generating coil; and said magnetic field shield is situated between said power-generating coil and said antenna.

14. The electronic timepiece of claim 12, wherein said magnetic field shield includes a stepping motor.

15. The electronic timepiece or claim 12, wherein said magnetic field shield includes a charge storage device.

16. The electronic timepiece of claim 15, wherein said charge storage device is secondary battery.

17. An electronic timepiece comprising:

a power-generation mechanism having a rotary weight made from a conductive material;

a generator for converting mechanical energy generated by rotation of the rotary weight into electrical energy;

a time-measuring mechanism for measuring time; and a receiving mechanism having an antenna for receiving wireless information;

wherein the antenna is placed outside the outer circumferential edge, in the radial direction, of the rotation oath of the rotary weight;

said electronic timepiece further comprising:

a mechanical energy storage mechanism for storing the rotation energy generated by the rotation of the rotary weight as mechanical energy;

an energy transmission mechanism for transmitting the mechanical energy stored in the mechanical energy storage mechanism to the generator, said energy transmission mechanism being further coupled to time display hands; and a rotation control mechanism for controlling the rotation period of the generator.

18. The electronic timepiece of claim 17, wherein said generator comprises:

a pair of rotor circular plates rotated by energy from the rotary weight, said rotor circular plates being positioned a predetermined distance opposite each other with their axial direction being substantially perpendicular to a plane that includes an antenna core of said antenna;

magnets facing each other from opposed surfaces of said rotor circular plates; and a power-generation coil placed between said rotor circular plates, with an axial line of said power-generation coil being in a direction substantially perpendicular to the plane that includes said antenna core.

19. An electronic apparatus that includes a timepiece according to claim 1.

* * * * *

UNITED STATES PATENT AND TRADEMARK OFFICE

CERTIFICATE OF CORRECTION

PATENT NO. : 6,934,222 B2
DATED : August 23, 2005
INVENTOR(S) : Shigeyuki Fujimori It is certified that error appears in the above-identified patent and that said Letters Patent is hereby corrected as shown below:

Column 32,
Line 58, change “oath” to -- path --.

Signed and Sealed this

Fourteenth Day of March, 2006

JON W. DUDAS
*Director of the United States Patent and Trademark Office*